US006324989B1

(12) United States Patent
Taylor et al.

(10) Patent No.: US 6,324,989 B1
(45) Date of Patent: Dec. 4, 2001

(54) LOAD BEARING MATERIAL HANDLING SYSTEM HAVING PNEUMATIC AND ELECTRICAL DELIVERY CAPABILITIES

(75) Inventors: Blake Taylor, Romeo, MI (US); Gary Haas, Gibsonburg, OH (US); Stan Owsen, Clinton Township, MI (US)

(73) Assignee: Three One Systems, LLC, Romeo, MI (US)

( * ) Notice: Subject to any disclaimer, the term of this patent is extended or adjusted under 35 U.S.C. 154(b) by 0 days.

(21) Appl. No.: 09/483,324

(22) Filed: Jan. 14, 2000

Related U.S. Application Data

(60) Provisional application No. 60/116,050, filed on Jan. 14, 1999.

(51) Int. Cl.[7] ..... B61B 3/00

(52) U.S. Cl. ..... 104/93; 104/89; 104/95; 104/106; 191/23 A; 191/33 R; 191/23 R

(58) Field of Search ..... 104/89, 93, 94, 104/95, 106, 107, 109; 105/148, 150, 153, 154, 155; 191/22 R, 23 R, 25, 23 A, 33 R

(56) References Cited

U.S. PATENT DOCUMENTS

| | | | | |
|---|---|---|---|---|
| 3,345,471 | * | 10/1967 | Kilburg | 191/45 |
| 3,772,482 | * | 11/1973 | Ross, Jr. | 191/23 |
| 3,834,315 | * | 9/1974 | Warnet | 104/88 |
| 4,166,419 | * | 9/1979 | Ardeleanu | 104/138 R |
| 4,296,774 | | 10/1981 | Kagi et al. | 137/322 |
| 4,296,775 | | 10/1981 | Kagi et al. | 137/322 |
| 4,375,822 | | 3/1983 | Kagi et al. | 137/322 |
| 4,424,827 | * | 1/1984 | Kagi et al. | 137/320 |
| 4,510,845 | | 4/1985 | Kagi et al. | 91/180 |
| 4,531,460 | * | 7/1985 | Pamer | 105/150 |
| 5,297,661 | * | 3/1994 | Tschurbanoff | 191/38 |
| 5,555,814 | * | 9/1996 | Burkhalter et al. | 104/107 |

* cited by examiner

*Primary Examiner*—S. Joseph Morano
*Assistant Examiner*—Frantz F. Jules
(74) *Attorney, Agent, or Firm*—Bliss McGlynn & Nolan, P.C.

(57) ABSTRACT

A load bearing material handling system including a rail having a hanger portion, a body portion defining a conduit extending for at least a portion of the length of the rail and a flange portion adapted to movably support a trolley thereupon. The flange portion includes at least one runway surface and at least one kick up surface disposed in spaced relationship with respect to the runway surface so as to define a mounting surface disposed therebetween and which is adapted to support an electrical bus along at least a portion of the length of the rail. The rail supports a pneumatic trolley having a pair of opposed frame members and a housing extending therebetween and which is adapted to supply air to a pneumatically actuated tool which is movably supported by the trolley along the rail.

19 Claims, 16 Drawing Sheets

98
102
112
134
122
106
132
116
128
120
140
152
124
136
118
96
126
146
148
114
150
110
108
153
138
142
144
258
130
258
252
254
276
260
264
244
274
270
272
256
266
262
204
276
246
274
250
205
268
220
234
232

LOAD BEARING MATERIAL HANDLING SYSTEM HAVING PNEUMATIC AND ELECTRICAL DELIVERY CAPABILITIES

This application claims the benefit of U.S. Provisional Application Ser. No. 60/116,050, filed Jan. 14, 1999.

BACKGROUND OF THE INVENTION

1. Field of the Invention

The present invention relates, generally, to material handling systems and more specifically, to material handling systems having pneumatic, electrical as well as load bearing capabilities.

2. Description of the Related Art

Industrial environments including, for example, light and heavy manufacturing, distribution and even sales of various industrial equipment and components typically involve pneumatically and/or electrically powered equipment as well as material handling applications. Among other things, industrial environments of this type generally include a source of pneumatic power, also known as "shop air" typically employed to operate pneumatic equipment, a source of electrical power used for operating electrical equipment and material handling systems such as cranes and rails having trolleys for supporting equipment and moving material about the shop or plant.

In the related art, pneumatic power is often delivered to the shop via steel conduits called "black pipe." The black pipe is typically elevated above the shop floor and criss-crosses the plant. A plurality of branch lines are fixed to the black pipe and provide ½" ID air to pneumatically powered tools and other equipment throughout the shop. However, the pneumatic power delivery systems employed in the related art suffer from various disadvantages. For example, the air flowing through the black pipe generally includes moisture which often condenses in the pipe resulting in rust and corrosion. Due in part to this corrosion, the steel black pipe and the many branch lines extending therefrom sometimes leak, often resulting in thousands of dollars of lost power in certain industrial environments. Where many pneumatically operated tools or other equipment are employed, a given shop may become cluttered with a spaghetti-like array of branch lines and connections to branch lines hanging overhead all providing shop air to the tools. This is due, in part, because the pneumatic tools in general are not easily moved from work station to work station without disconnecting the tool from one branch line and reconnecting it to another. This situation contributes to a multiplicity of branch lines and pneumatic tools required to adequately perform given tasks. Where overhead material handling systems are employed, the plant environment becomes even more cluttered.

Electrical power is delivered throughout the shop in a number of ways. Electrical outlets are strategically placed throughout the plant. Power cords and extension cords are employed to connect various electrically operated tools and equipment to these outlets. But, where a number of electrically operated tools are employed, power cords and extension cords litter aisle ways and work areas creating safety hazards and a less than ergonomic work environment.

Attempts have been made at simplifying these conditions in the related art. Heretofore, it has been proposed to provide a pneumatic conduit including a branch line capable of being detachably coupled to the conduit and movable relative to the conduit to provide greater flexibility and ease of mobility relative to supplying pressure to pneumatically actuated equipment. U.S. Pat. No. 4,296,774 issued Oct. 27, 1981; U.S. Pat. No. 4,296,775 issued Oct. 27, 1981; U.S. Pat. No. 4,375,822 issued Mar. 8, 1983; and U.S. Pat. No. 4,424,827 issued Jan. 10, 1984 all to Kagi et al. each disclose examples of such devices.

While, in principal, the devices disclosed in the above-identified patents provide operational improvements over the prior art, some disadvantages remain. For example, the devices disclosed in the Kagi et al. patents do not assist in supplying electrical power in any given application. Further, the movable branch lines are limited in their pneumatic capacity. Additionally, while tools and other light components may be carried on the pneumatic conduit, the devices disclosed by Kagi et al. are generally not adapted for use in load bearing material handling applications. Accordingly, there remains a need in the art for a load bearing material handling system including integrated pneumatic and electrical power source capabilities.

SUMMARY OF THE INVENTION

The present invention overcomes the disadvantages of the related art in a load bearing material handling system including a pneumatic trolley and a load bearing trolley, both of which may be supported on a bridge and runway system and/or a tool rail having both pneumatic and electrical power delivery capabilities. The bridge rail, runway rail and tool rail have essentially the same structure and only vary in size depending on the loading capacity desired for the rail. Each rail includes a hanger portion by which the rail is supported over a work area via an I-beam or some other structure. In addition, each rail has a flange portion by which the trolleys are supported for rectilinear movement thereon. Finally, each rail has a body portion. The body forms a conduit through which pressurized air is delivered to pneumatically actuated tools. The rails and trolleys also have the capability of supplying electrical power to electrically actuated tools which are operatively connected to the trolleys. More specifically, the flange portion includes at least one runway surface extending for at least a portion of the length of the rail and laterally outward with respect to the body. In addition, the flange portion includes at least one kick up surface extending for at least a portion of the length of the rail and disposed in spaced relationship with respect to the runway surface so as to define a mounting surface located therebetween. The mounting surface is adapted to support an electrical bus along at least a portion of the length of the rail.

Furthermore, the load bearing material handling system of the present invention also includes a rail having a hanger portion that is adapted to interconnect the rail to a support structure. The rail has a body portion that defines a conduit extending for at least a portion of the length of the rail and through which pressurized air may be delivered to pneumatically actuated tools. In addition, the rail includes a flange portion that is adapted to moveably support a trolley thereupon. The conduit includes a plurality of openings disposed in spaced relationship with respect to one another along the length of the rail. A plurality of valves is supported in the conduit through the openings. A source of pressurized air is in fluid communication with the conduit such that the conduit provides fluid communication between the source of pressurized air and the plurality of valves. The flange portion of the rail includes at least one runway surface extending for at least a portion of the length of the rail and the laterally outward with respect to the body. At least one kick-up surface extends for at least a portion of the length of the rail and is disposed in spaced relationship with respect to the runway surface so as to define a mounting surface disposed therebetween and which is adapted to support and electrical bus along at least a portion of the length of the rail.

The rails do not corrode like the black pipe of the prior art. Thus, leaks due to corrosion are eliminated thereby significantly reducing associated power losses. Cluttered work environments due to the spaghetti-like array of branch lines, hoses and connectors to branch lines like the related art are also eliminated. These results are achieved in a pneumatic rail and trolley system which provides the sufficient air flow and pressure necessary to power pneumatic tools. In addition, electrical power may also be supplied to the power tools as the trolley is moved along the rail. This feature greatly reduces the need for power cords and extension cords which typically litter aisleways and work areas in the art.

DETAILED DESCRIPTION OF THE PREFERRED EMBODIMENT(S)

The following description of the preferred embodiments of the present invention is for purposes of illustration only, and not by way of limitation. Those having ordinary skill in the art will appreciate that the terminology herein is used merely for descriptive purposes and that many modifications and variations of the invention are possible in light of the teachings which follow.

Figure 1:
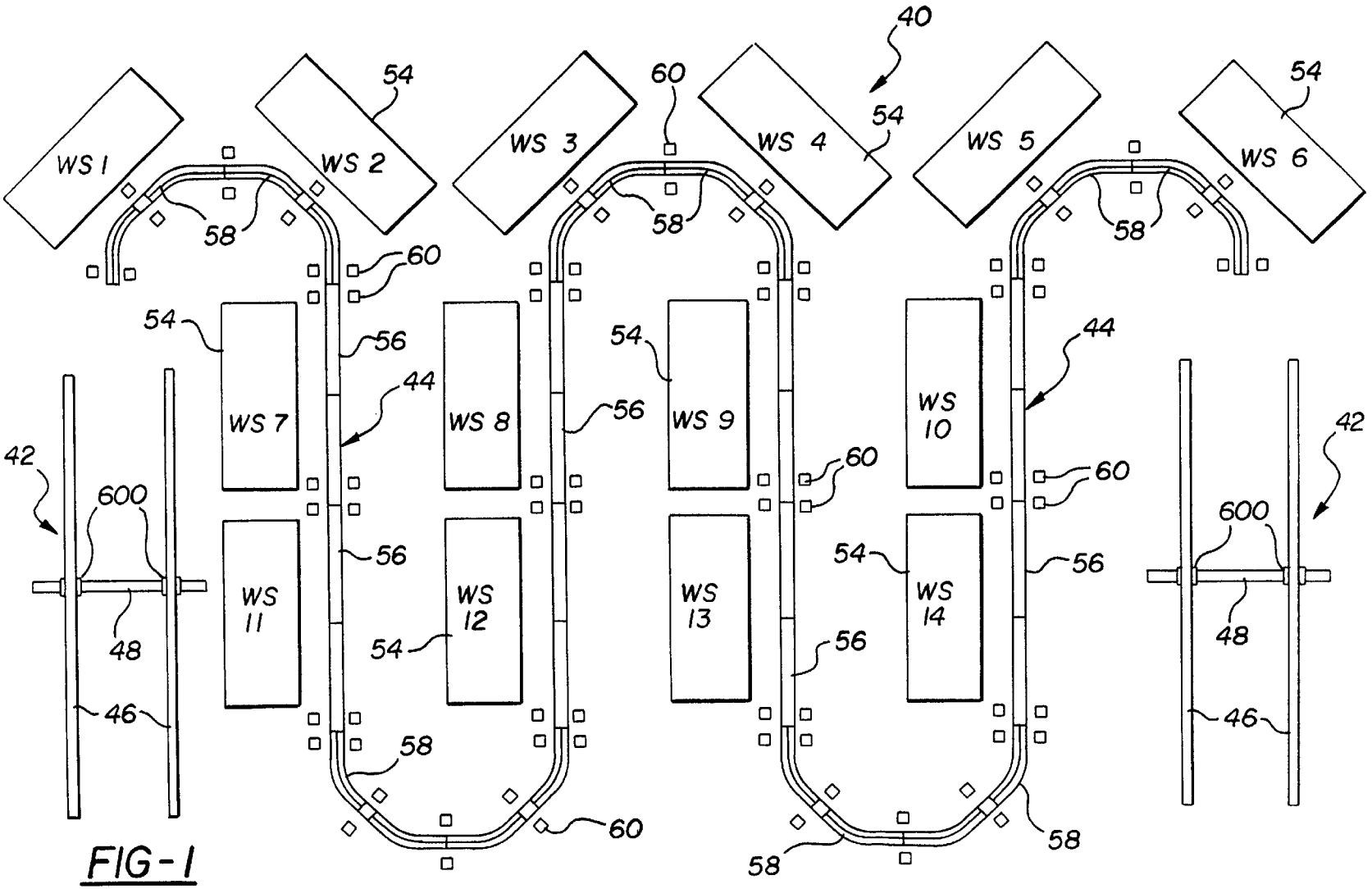
FIG. 1 is a schematic top view of a work environment employing the material handling system of the present invention.

Referring now to FIG. 1, a material handling system of the present invention is schematically represented at 40 and shown in one example of a possible work environment. As shown here, the material handling system 40 includes a load bearing bridge and runway system, generally indicated at 42, as well as a pneumatic tool rail, generally indicated at 44. Both the bridge and runway system 42 as well as the tool rail 44 have pneumatic power delivery capabilities and may have electrical power delivery capabilities as described in greater detail below. Additionally, it will be appreciated from the following description that the tool rail 44 may also have load bearing capabilities.

Figure 2:
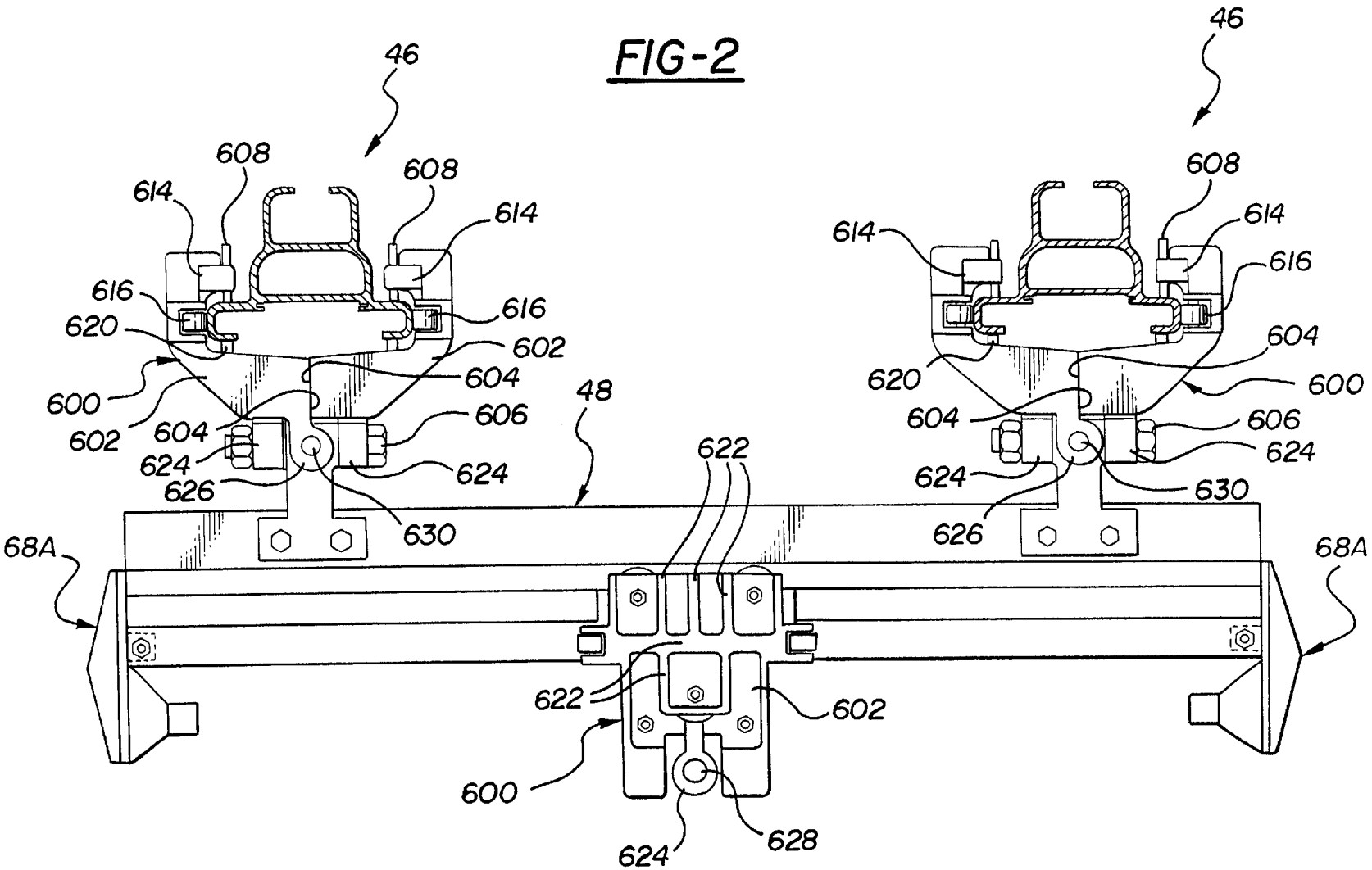
FIG. 2 is a partial cross-section view of a bridge and runway system of the present invention illustrating the load bearing trolley.

In one embodiment illustrated in FIGS. 1 and 2, the bridge and runway system 42 includes two parallel runway rails 46 with a bridge rail 48 movably suspended therebetween by load bearing trolleys 600. The load bearing trolleys schematically represented at 600 will be described in greater detail below with respect to FIGS. 27 through 30. In addition, the bridge rail 48 may movably support pneumatic trolleys 200, 400 discussed with respect to FIGS. 17 through 26 as will be clear from the description that follows.

In FIG. 1, the tool rail 44 is shown traversing the work environment with work stations 54 strategically positioned at spaced intervals adjacent the bridge and runway system 42 as well as the tool rail 44. To that end, the tool rail 44 includes a plurality of straight segments 56 and curved segments 58 both of which may also be supported by floor supports, schematically represented at 60, or attached to overhead I beams or any other load bearing member associated with the structure in which the work environment may be housed. Sequential, adjacent straight and/or curved segments 56, 58 are coupled together to define a continuous rail. Either pneumatic trolleys 200, 400 or load bearing trolleys 600 may be movably supported along the bridge, runway or tool rails 48, 46, 44, respectively. The pneumatic trolleys 200, 400 are employed for selectively providing fluid communication between a source of pneumatic power through the rail to a pneumatically operated tool. The load bearing trolleys 600 are employed for moving material along the rails or as a load bearing member in a bridged or runway system. In this way, pneumatic or electrically operated tools and materials may be quickly and easily moved between work stations 54. The bridge rail 48 and runway rail 46 as well as the tool rail 44 will be discussed in greater detail below in connection with FIGS. 3A through 3F.

Bridge Rail Runway Rail and Pneumatic Rails

The structure of the bridge rail 48 and runway rail 46 as well as the tool rail 44 is essentially the same as shown in FIGS. 3A through 3F and only varies depending upon the loading capacity desired for each rail as will be described in greater detail below. Accordingly, the description which follows is the same for each type of rail 44, 46, 48 identified above.

Figure 3A:
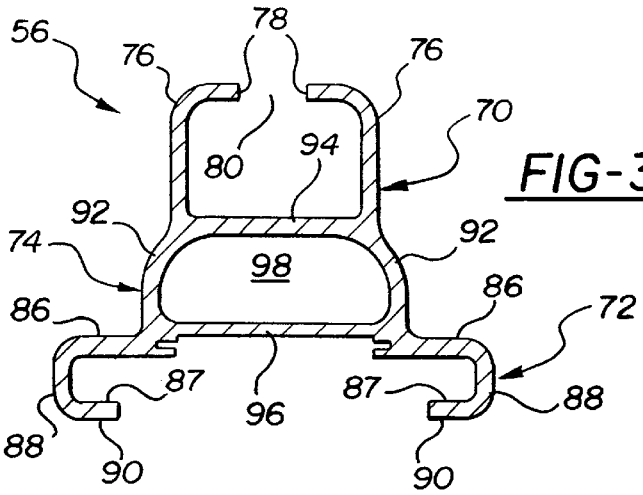
FIG. 3A is a cross-sectional view of the straight rail segment for a rail of the present invention.
Figure 3B:
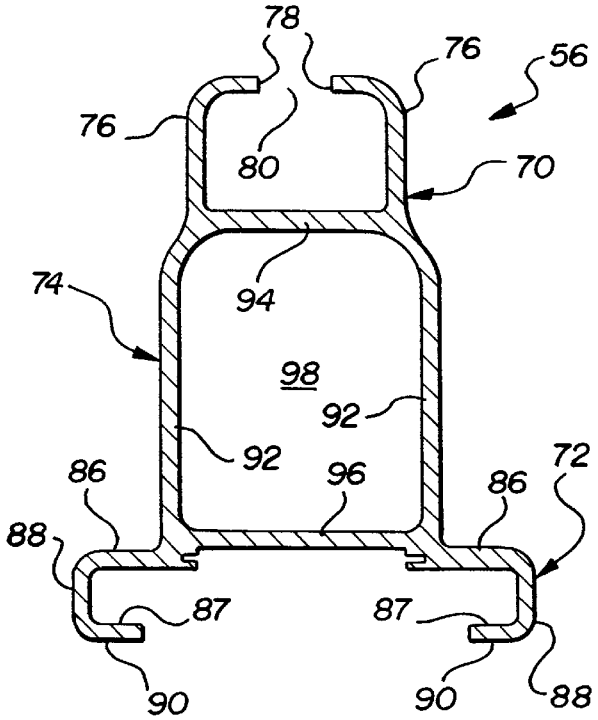
FIG. 3B is a cross-sectional view of another embodiment of the straight rail segment for a rail of the present invention which has a higher loading capacity than the rail illustrated in FIG. 3A.
Figure 3C:
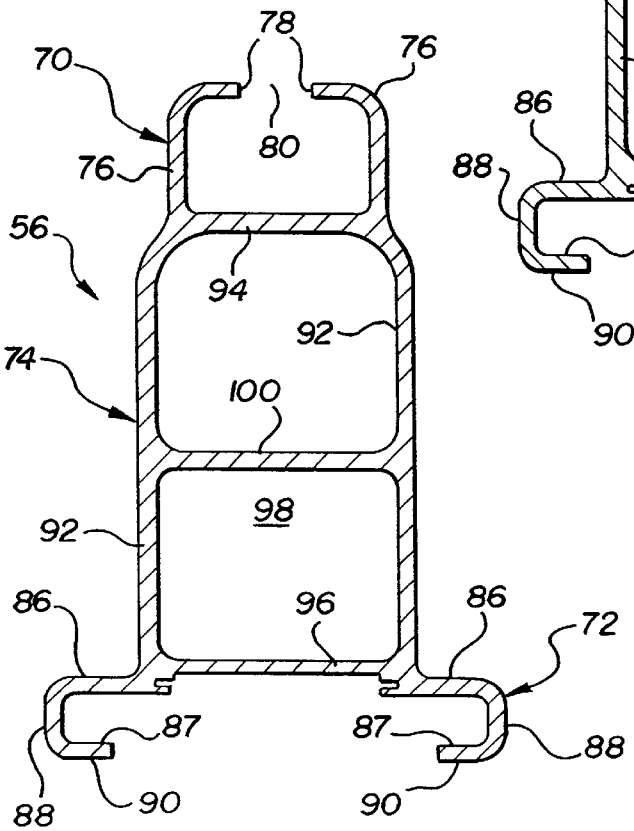
FIG. 3C is a cross-sectional view of another embodiment of the straight rail segment for a rail of the present invention which has an even higher loading capacity than the rails illustrated in FIGS. 3A–3B.
Figure 3D:
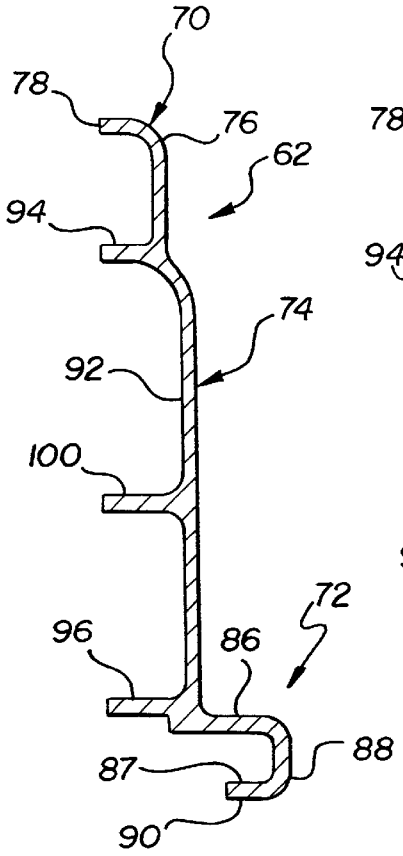
FIG. 3D is a cross-sectional view of one half of a curved segment of one embodiment of the rail of the present invention.
Figure 3E:
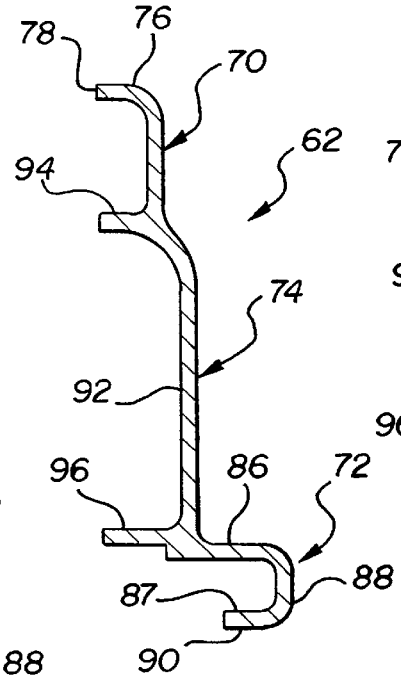
FIG. 3E is a cross-sectional view of one half of another embodiment of the curved segment of the rail of the present invention.
Figure 3F:
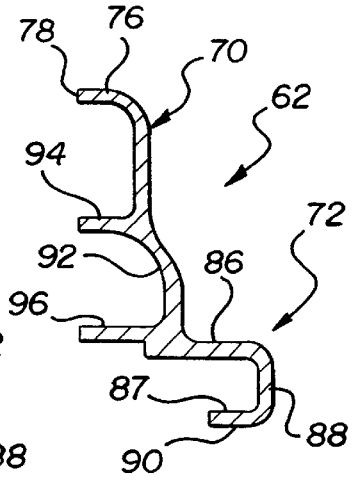
FIG. 3F is a cross-sectional view of one half of another embodiment of a curved segment of the rail of the present invention.

Each straight rail segment 56 is manufactured in sections of one piece, or integral, extruded anodized aluminum alloy, 6005T5 ANSI standard. The curved sections 58 are also made of extruded anodized aluminum alloy 6005T5 but, as illustrated in FIGS. 3D through 3F, are manufactured in two half pieces 62. The half pieces form inner and outer arcuate rail segments which are joined together to form a curved rail segment 58. While the curved rails segments 58 may have electrical power delivery capabilities, they do not have pneumatic delivery capabilities in the embodiment disclosed here. However, those having ordinary skill in the art will appreciate that the curved sections 58 may be adapted for pneumatic capabilities from the description which follows.

Sequential rail sections are coupled together by spliced connections, generally indicated at 64 in FIGS. 4 and 5, which serve to seal the joint between adjacent rail sections in an air tight manner as will be described in greater detail below. In addition, the rails are supplied with shop air through air couplings 66A–B (FIGS. 6 through 10). The air coupling 66A is adapted for use at the terminal end of a rail and therefore includes an axially disposed, threaded opening 65B which may be coupled to a source of pressurized air. The air coupling 66A also includes bosses 67A which receive fasteners (not shown) used to mount the air coupling 66A to the rail. Alternatively, an air coupling 66B is adapted for use at an intermediate point of the rail and therefore includes a transversely disposed threaded opening 65B which may be coupled to a source of pressurized air. The air coupling 66B also includes bosses 67B which receive fasteners (not shown) used to mount the air coupling 66B to the rail. Thus, the air couplings 66A–B are adapted to interconnect the rail with a source of pneumatic pressure which will be described in greater detail below. The terminal end of any given open ended rail is plugged by an end stop 68A–B, examples of which are shown in FIGS. 11 through 14. The end stops 68A–B also serves as a seal and to stop or contain the trolleys 200, 400, 600 on any given rail.

Figure 15:
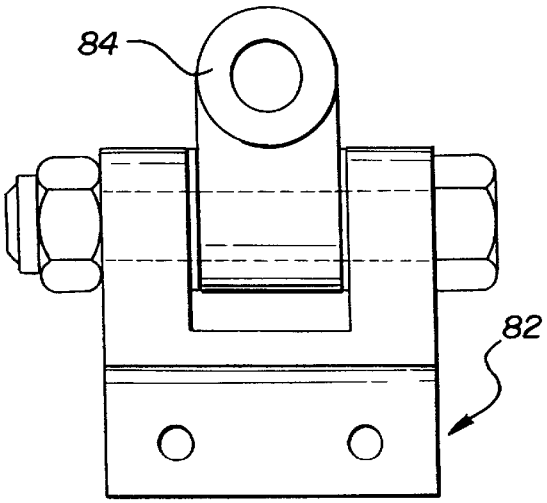
FIG. 15 is a side view of a hanger of the present invention.
Figure 16:
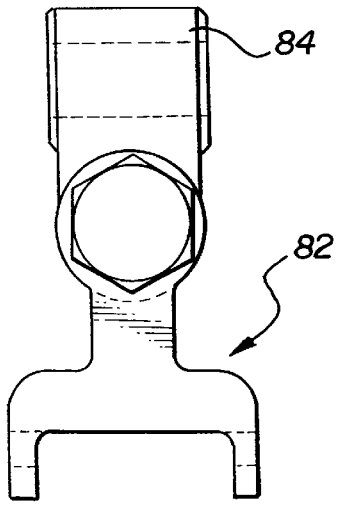
FIG. 16 is an end view of the hanger illustrated in FIG. 15.

Referring now to FIGS. 3A through 3F, the rails include a hanger portion, generally indicated at 70, a flange portion, generally indicated at 72, and a body 74 extending therebetween. The hanger portion 70 is adapted to interconnect the rail to a support structure. The hanger portion 70 is defined by a pair of spaced claws 76 extending upwardly relative to the body 74 and arcuately inward toward one another at the terminal ends 78 of the claws 76 to present a gap 80 therebetween. The claws 76 are adapted to engage a plurality of inverted, Y-shaped yokes 82 shown at FIGS. 15 and 16 attached to connection 84. The yokes 82 extend through the gap 80 between the opposed claws 38. The yokes 82 are suspended via the connection 84 from I-beams, trolleys or other load bearing members associated with the structure in which the work area is housed. In this way, the rails may be suspended above the work area.

The flange portion 72 is located opposite the hanger portion 70 and serves to movably support either the pneumatic trolleys 200, 400 or the load bearing trolleys 600 as they are rolled along the rails. The flange portion 72 includes at least one runway surface 86 which extends for at least a portion of the length of the rail and laterally outward with respect to the body 74. At least one kick up surface 90 extends for at least a portion of the length of the rail and is disposed in spaced relationship with respect to the runway surface 86 so as to define a mounting surface 87 located therebetween. The mounting surface 87 is adapted to support an electrical bus along at least a portion of the length of the rail as will be described in greater detail with respect to FIG. 20. The flange portion 72 further includes at least one guide roller surface 88 disposed between the runway surface 86 and the kick up surface 90 and which extends for at least a portion of the length of the rail. More specifically, in the preferred embodiment, the flange portion 72 defines a pair of parallel runway surfaces 86 extending along the longitudinal length of the rail and laterally outward relative to opposite sides of the body 74. The pair of runway surfaces 86 merge into arcuately formed guide roller surfaces 88 which also extend parallel to one another along the longitudinal axial length of the rails. Each of the pair of guide roller surface 88 merges into an inwardly extending kick up surface 90 which extends substantially parallel to, but spaced from, the running surface 86 so as to define a pair of mounting surfaces 87. The guide roller surface 88 is engaged by guide rollers and the kick up surface 90 may be engaged by kick up rollers on the trolleys as will be described below.

The body 74 of the rail is defined by a pair of spaced side walls 92, an upper wall 94 and a lower wall 96. Together, these walls 92, 94, 96 form a channel or conduit 98 extending for at least a portion of the length of the rails and which spans adjacent sequential ones of the rail segments 56. Thus, the walls 92, 94, 96 define the inner diameter of the conduit 98. The conduit 98 delivers clean air from a source of pneumatic pressure (not shown) operatively coupled to the rail through an appropriate coupling 66A–B (FIGS. 6–10). As mentioned above, a splice connector 64 is disposed between adjacent, sequential ones of the rail segments 56.

Figure 4:
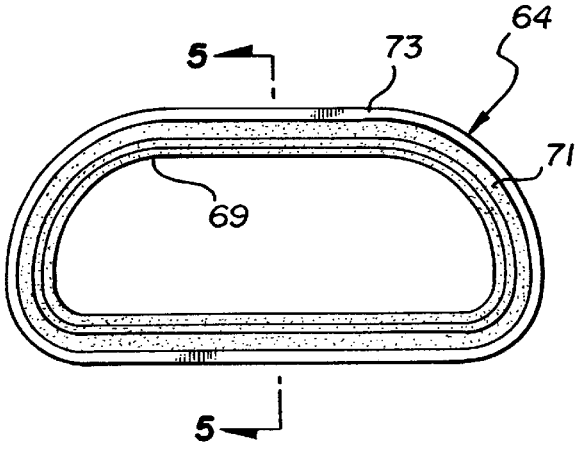
FIG. 4 is an end view of a splice connector used between adjacent rail segments of the present invention.
Figure 5:
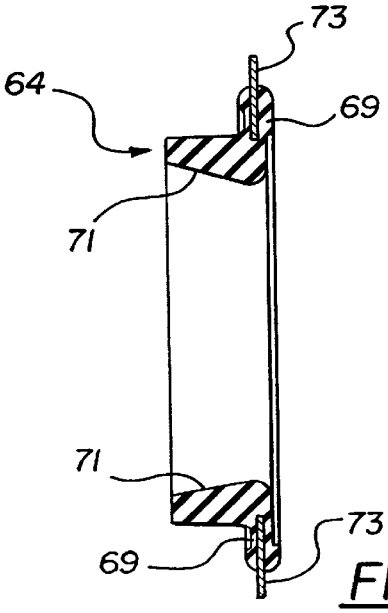
FIG. 5 is a cross-sectional side view of the splice connector taken along lines 5—5 of FIG. 4.
Figure 6:
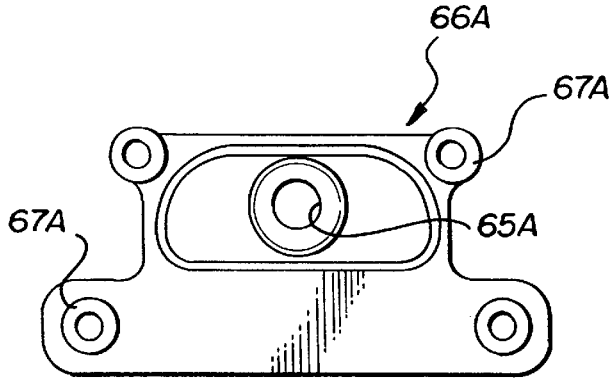
FIG. 6 is an end view of one embodiment of an air coupling of the present invention.
Figure 7:
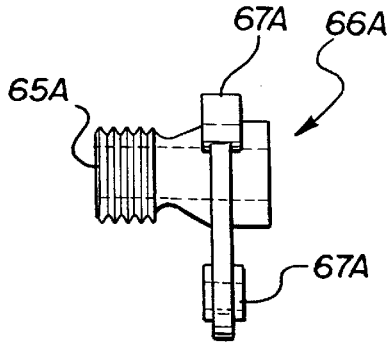
FIG. 7 is a side view of the air coupling illustrated in FIG. 6.
Figure 8:
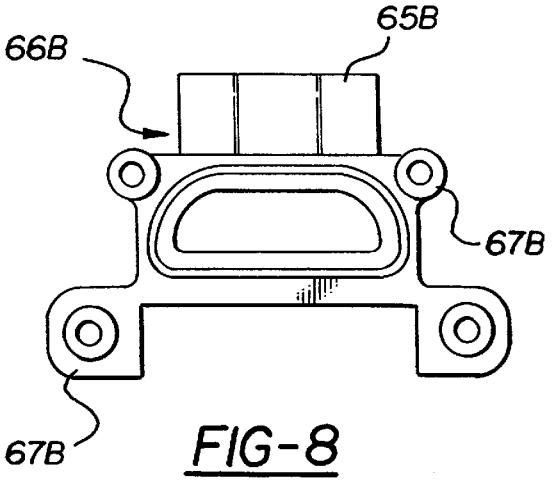
FIG. 8 is an end view of another embodiment of an air coupling of the present invention.
Figure 9:
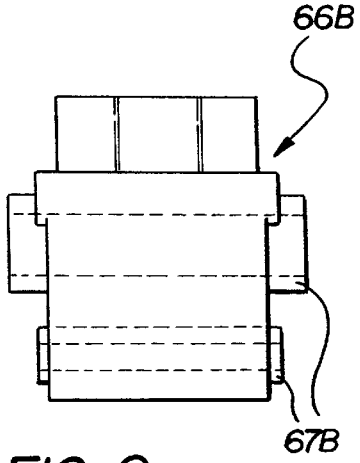
FIG. 9 is a side view of the air coupling illustrated in FIG. 8.
Figure 10:
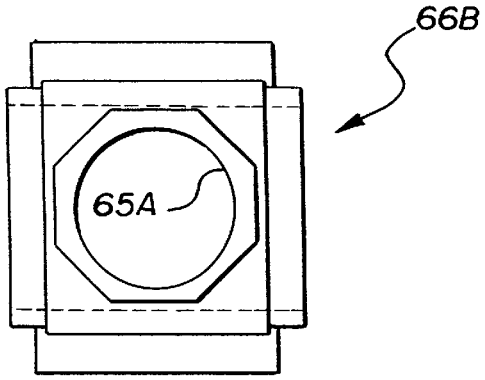
FIG. 10 is a top view of the air coupling illustrated in FIG. 9.
Figure 11:
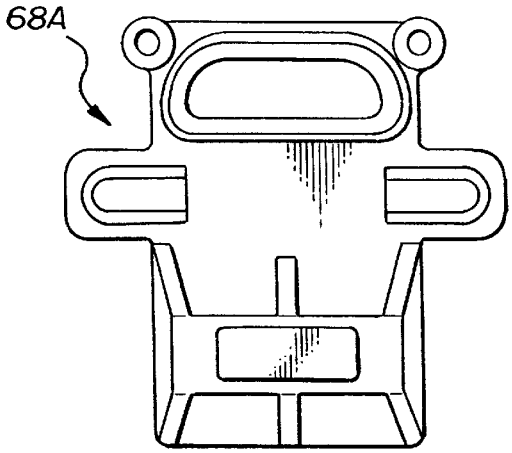
FIG. 11 is an end view of one embodiment of an end stop for a rail of the present invention.
Figure 12:
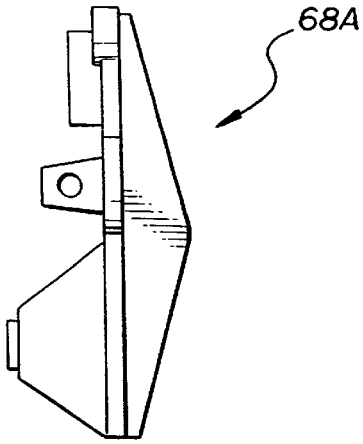
FIG. 12 is a side view of the end stop illustrated in FIG. 11.
Figure 13:
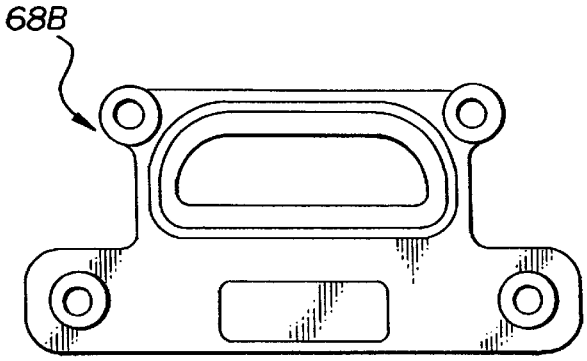
FIG. 13 is another embodiment of an end stop of the present invention adapted for use in a mid-rail application.
Figure 14:
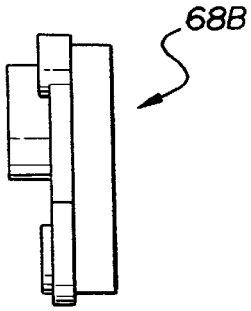
FIG. 14 is a side view of the end stop illustrated in FIG. 13.

Referring specifically to FIGS. 4 and 5, the splice connector 64 includes a gasket portion 69 which corresponds in shape to the shape of the conduit 98 and which is adapted to be clamped between adjacent ones of the rail segments 56. In addition, the splice connector includes a sealing portion 71 which extends from the gasket portion 69 in the direction of the conduit 98. Furthermore, the sealing portion 71 is adapted to be disposed in sealing engagement with the inner diameter of the conduit 98. The gasket portion 69 is reinforced with a molded in stainless steel plate 73. Furthermore, the gasket and seal portions 69, 71 are preferably made of a buna-n-70 material and are flexible as well as compressible. In this way, the splice connectors 64 define an air tight seal of the conduit which extends between adjacent rail segments 56. The splice connectors 64 have a thin profile which has been exaggerated in the cross-section of FIG. 5. Due, in part, to this thin profile and the flexible, buna-n rubber material employed for the connector 64, the splice connectors 64 may be removed from between adjacent rail segments 56 during maintenance or otherwise without disassembling other components of the rail system. Accordingly, the splice connectors 64 facilitate the assembly and disassembly of the load bearing material handling system of the present invention.

The size of the body 74, as illustrated in cross-section in FIGS. 3A through 3C and 3D through 3F may vary depending primarily on the loading capacity of any given application. The higher the loads, the larger the body 74 of the rail. At higher load capacities, the body 74 may also include an internal partition wall 100 (FIGS. 3C through 3D) extending between the side walls 92 and disposed between the upper and lower walls 94, 96 for added strength. The internal partition wall 100 also functions to limit the size of the conduit 98 which thereby limits the power necessary to generate the pneumatic pressure in the conduit sufficient to power the tools. Thus, rails having larger bodies 74 are especially suitable for use in heaver, load bearing applications such as in the case of the bridge and runway systems 42.

Pneumatic Rail Valve

Figure 17:
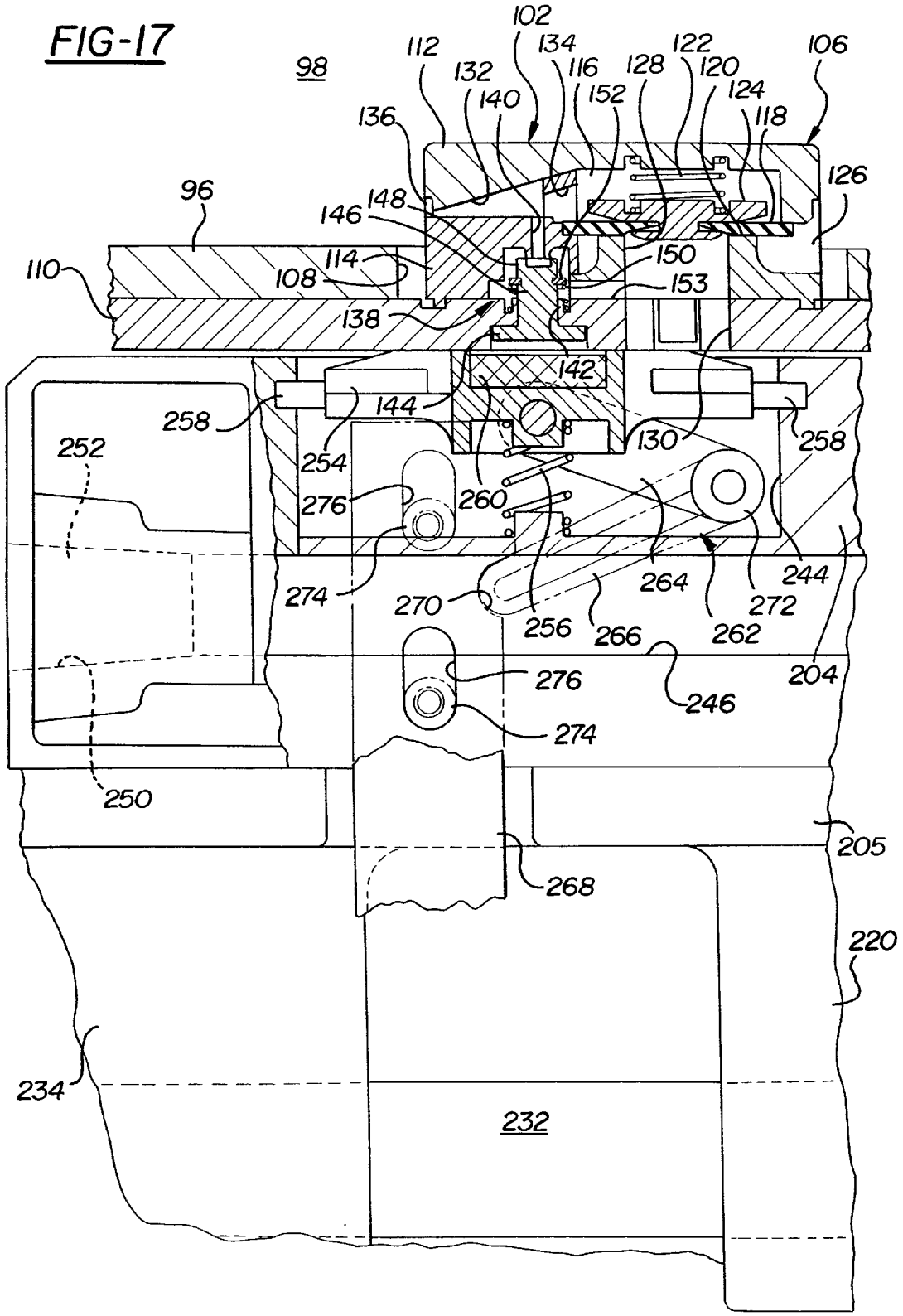
FIG. 17 is a partial cross-sectional side view illustrating the rail valve as well as the housing of one embodiment of the pneumatic trolley of the present invention.

Referring now to FIG. 17, a plurality of pneumatic rail valves, generally indicated at 102, are supported at spaced, predetermined positions within the conduit 98 of the rails and control the flow of pressurized air from the conduit 98 through a corresponding trolley housing 204, 404 carried by the respective pneumatic trolley 200, 400 as will be described in greater detail below.

The pneumatic rail valves 102 each include a valve housing, generally indicated at 106, which extends through openings 108 in the lower wall 96 of the conduit 98. To this end, there are a number of openings 108 which are spaced along the lower wall 96 along the longitudinal length of the rail. Each housing 106 rests upon a valve plate 110 which is removably mounted to the underside of the rail lower wall 96. The valve housing 106 includes a cap 112 which is mounted to a valve body 114. Together, the cap 112 and valve body 114 define a counter pressure chamber 116. A valve member 118 is biased into engagement with a valve seat 120 presented by the valve body 114 under the influence of a coiled spring 122 in conjunction with a weighted retainer 124. The valve member 118 controls the flow of air at ambient rail pressure from an inlet 126 in the housing 106 and into the main valve passage 128. This air then flows past an outlet port 130 in the valve plate 110 and into the pneumatic trolley 200, 400 as will be described in greater detail below.

The counter pressure chamber 116 is in fluid communication with a tapered channel 132 via a short connecting port 134 located opposite the inlet 126, as viewed in FIG. 17. The tapered channel 132 is exposed to the ambient rail pressure in the conduit 98 via a small restriction orifice 136 at the narrow end of the tapered channel 132. Additionally, a control valve, generally indicated at 138, is operable to control the flow of air from the tapered channel 132 and thus the counter pressure chamber 116 via a control orifice 140.

The control valve 138 is supported in a stepped vertical bore 142 extending through the valve plate 110 to the left of the outlet port 130 as viewed in FIG. 17. The control valve 138 includes a ferromagnetic head 144 and a shaft 146. The shaft 146 terminates in a plunger 148 which seats against an opening in the control orifice 140. The control valve 138 is continuously biased to a closed position with the plunger 148 sealing the control orifice 140 under the influence of a coiled spring 150 acting between the valve plate 110 and a retaining ring 152 which encircles the shaft 146 of the control valve 138. However, the control valve 138 is also movable to unseat the plunger 148 from the opening in the control orifice 140. When this occurs, the pressure in the counter-pressure chamber 116 is immediately reduced as the air flows out of the chamber 116 through the control orifice 140 and ultimately out port 130 via a shunt 153. This also creates a pressure imbalance acting on the valve member 118 which is exposed to rail pressure via the inlet 126. More specifically, ambient rail pressure acting on the valve member 118 through the inlet 126 in the valve housing 106 will unseat the valve member 118 against the biasing force of the coiled spring 122 and the weighted retainer 124. Air at the ambient rail pressure then flows from the conduit 98 into the housing 106, through the valve passage 128, and into the pneumatic trolley 200, 400 via outlet passage 130. Air pressure is delivered from the pneumatic trolley 200, 400 to a tool as will be described in greater detail below.

Pneumatic Trolley

Figure 18:
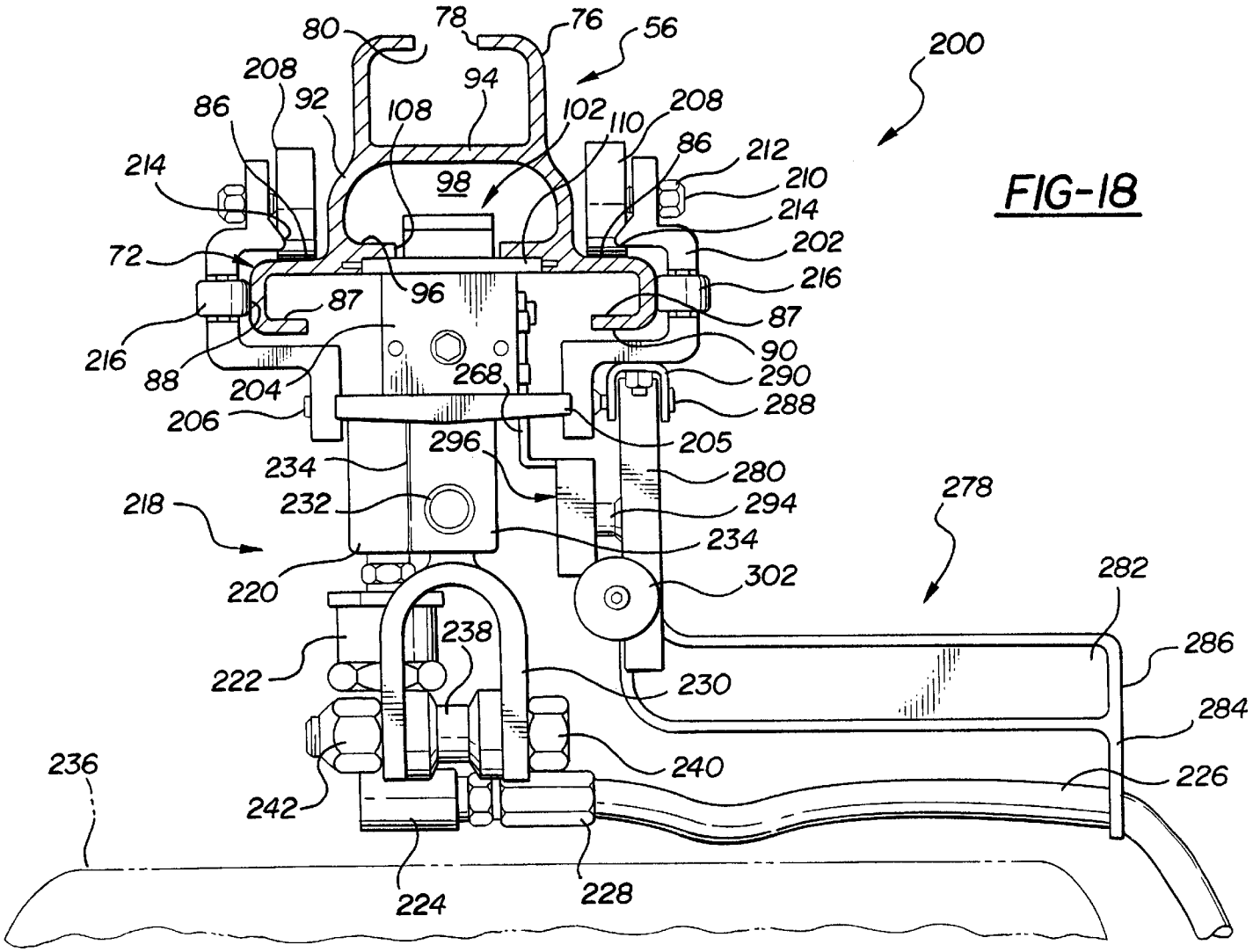
FIG. 18 is an end view of one embodiment of the pneumatic trolley of the present invention mounted on a rail.

The pneumatic trolley 200 is illustrated in FIGS. 17 through 20. With reference now to FIG. 18, the pneumatic trolley 200 includes a pair of opposed, but identical, frame members 202. The frame members 202 may be manufactured from extruded, anodized aluminum, 6005T5 ANSI standard, plastic, injectable polymer or any other suitable material. If made from a polymer, the inventors have found that UV stabilized Delrin 577, a 20% glass filled reinforced acetal available from Dupont works well for this purpose. The opposed frame members 202 are interconnected by a base plate 205 extending therebetween at the lower margins of the frame members 202 and beneath the rail. The base plate 205 may be removably mounted to each frame member 202 via suitable fasteners schematically represented at 206. Each frame member 202 is supported for rolling contact with the rail. More specifically, each frame member 202 includes one or more trolley wheels 208 rotatably mounted thereto and adapted for rolling contact with a corresponding runway surface 86 of the rail flange portion 72. To this end, each trolley wheel 208 may be rotatably supported by a shaft defining an axis. The shaft terminates in a stud 210 extending through a complementary hole in the frame member 202 and fixed thereto by a lock nut 212, or any other suitable fastening mechanism. Each frame member 202 also presents at least one safety lug 214 which projects over the plane of the associated runway surface 86 of the rail flange portion 72. In the unlikely event of a catastrophic failure of one or more trolley wheels 208, the safety lug 214 will catch the running surface 86 and prevent the trolley 200 from falling off the rail.

From the trolley wheel 208, each frame member 202 generally follows the contour of the flange portion 72 of the rail. Further, at least one or more guide rollers 216 is roll pinned or otherwise mounted to each frame member 202 opposite the guide roller surface 88 of the flange portion 72. Each guide roller 216 is adapted for rolling engagement with the guide roller surface 88 and assists in stabilizing the trolley 200 relative to the rail. More specifically, the guide rollers 216 are rotatable about an axis which is perpendicular to the axis of rotation of the trolley wheel 208 supported on the associated frame member 202. Additionally, the trolley may also include a kick up roller (not shown in the figures) which engages the kick up surface 90 of the rail flange portion 72. The kick up roller is rotatable about an axis parallel to the axis of rotation of the trolley wheel 208. However, kick up rollers are typically employed in connection with the load bearing trolleys 600, illustrated in FIGS. 27 through 30, which will be described in greater detail below.

The trolley wheel 208 may be manufactured from Delrin 570, which is a 20% glass-filled, reinforced, injection acetal available from Dupont. Additionally, the guide rollers may also be manufactured from Delrin 570 or even Celcon M90 which is also an injection acetal but is available from Hoechst Celanese. Together, the trolley wheels 208, guide rollers 216, and to the extent they are employed, the kick up rollers facilitate smooth, rectilinear motion of the pneumatic trolley 200 along the rail.

An air body 218 may be integrally formed with the base plate 205 and is suspended therebeneath. The air body 218 includes a clevis 220 to which is coupled a check valve body 222. Air flows from the clevis 220 past a check valve in the check valve body 222 through an elbow 224 and into a polyurethane hose 226 via a fitting 228. The hose 226 provides fluid communication between the pneumatic trolley 200 and a pneumatic tool (not shown). Alternatively, the check valve may be incorporated into the housing 204 of the trolley 200 at any convenient location as will be clear from the description which follows with respect to FIG. 22.

A yoke 230 is suspended from a load pin 232 which extends between the air body 218 and a support body 234. The yoke 230 serves to support a balancer, related hoist equipment, or the like, which is generally indicated in phantom lines at 236. Alternatively, a pneumatically or electrically operated tool may be substituted for the device illustrated in phantom at 236, as will be appreciated by those having ordinary skill in the art. To that end, the yoke 230 may include a spool 238 captured between the prongs of the yoke 230 by a load bolt 240 and nut 242. Alternatively, any other type of support structure and fastening mechanism may be employed with the yoke 230 to suspend other equipment from the trolley 200.

Referring now to FIG. 17 and as mentioned above, the pneumatic trolley 200 includes a housing 204 supported upon the base plate 205 and extending between the opposed frame members 202. The inner workings of the trolley housing 204 operate to selectively open and close the rail valve 102 to provide and interrupt, respectively, pneumatic pressure to a tool. To that end, the trolley housing 204 includes an air chamber 244 which receives air from the conduit 98 through the rail valve 102. Fluid communication is provided from the air chamber 244 to the hose 226 and ultimately to a pneumatically operated tool via an axial flow passage 246 in the trolley housing 204 and an S-shaped port (not shown) extending through the clevis 220. Pneumatic pressure may also be supplied to any device (not shown) via a secondary port 250 in the axial flow passage 246. However, in the embodiment disclosed herein, the secondary port 250 is plugged at 252.

The flow of air into the air chamber 244 is controlled by the movement of an actuator such as a magnet head 254 which is movably supported within the air chamber 244 and is biased toward the top of the chamber 244 by a coiled spring 256 or any other suitable biasing member. The magnet head 254 is surrounded by a gasket or other suitable sealing device 258 which is operatively connected to the trolley housing 204. The magnet head 254 includes a magnet 260 supported therein. The magnet 260 is adapted to actuate the control valve 138 by attracting its ferromagnetic head 144 thereby unseating the plunger 148 from the opening in the control orifice 140 and opening the valve member 118 allowing pressurized air from the conduit 98 to flow into the air chamber 244 as described above.

The magnet head 254 may be moved away from the control valve 138 and against the biasing force of the coiled spring 256 by actuation of a lever, generally indicated at 262. This movement closes the control valve 138 which causes the valve member 118 to be seated on the valve seat 120 thereby interrupting the flow of air into the trolley 200.

The lever 262 includes a first member 264 operatively coupled to the magnet head 254 and a second member 266 operatively coupled to a vertically extending slide 268 via a notch 270. Both first and second members 264, 266 are rotatable together about a pin 272. While the lever 262 may be manufactured from discrete members 264, 266 and a pin 272, in the preferred embodiment as disclosed herein, the lever 262 is an integral, one-piece plastic device which is rotatable about the axis of the pin 272 to impart linear movement to the magnet head 254. The slide 268 is movably mounted to the valve housing 204 via fasteners 274 which are received in slots 276 on the slide 268. The lever and slide, 262, 268, respectively, form a part of a release mechanism, generally indicated at 278 in FIGS. 18 through 20 as will be described in greater detail below.

The release mechanism 278 may also include an upper arm 280 and a lower arm 282 which may be integrally formed together as shown in the figures or otherwise operatively fixed to each other. In the embodiment disclosed in these figures, the lower arm 282 extends generally transverse to the plane of the upper arm 280 and includes a downwardly extending hose retaining ring 284 integrally formed on the distal end 286 of the lower arm 282. The ring 284 is adapted to receive and support a portion of the pneumatic hose 226 for a purpose which will be described below.

Figure 19:
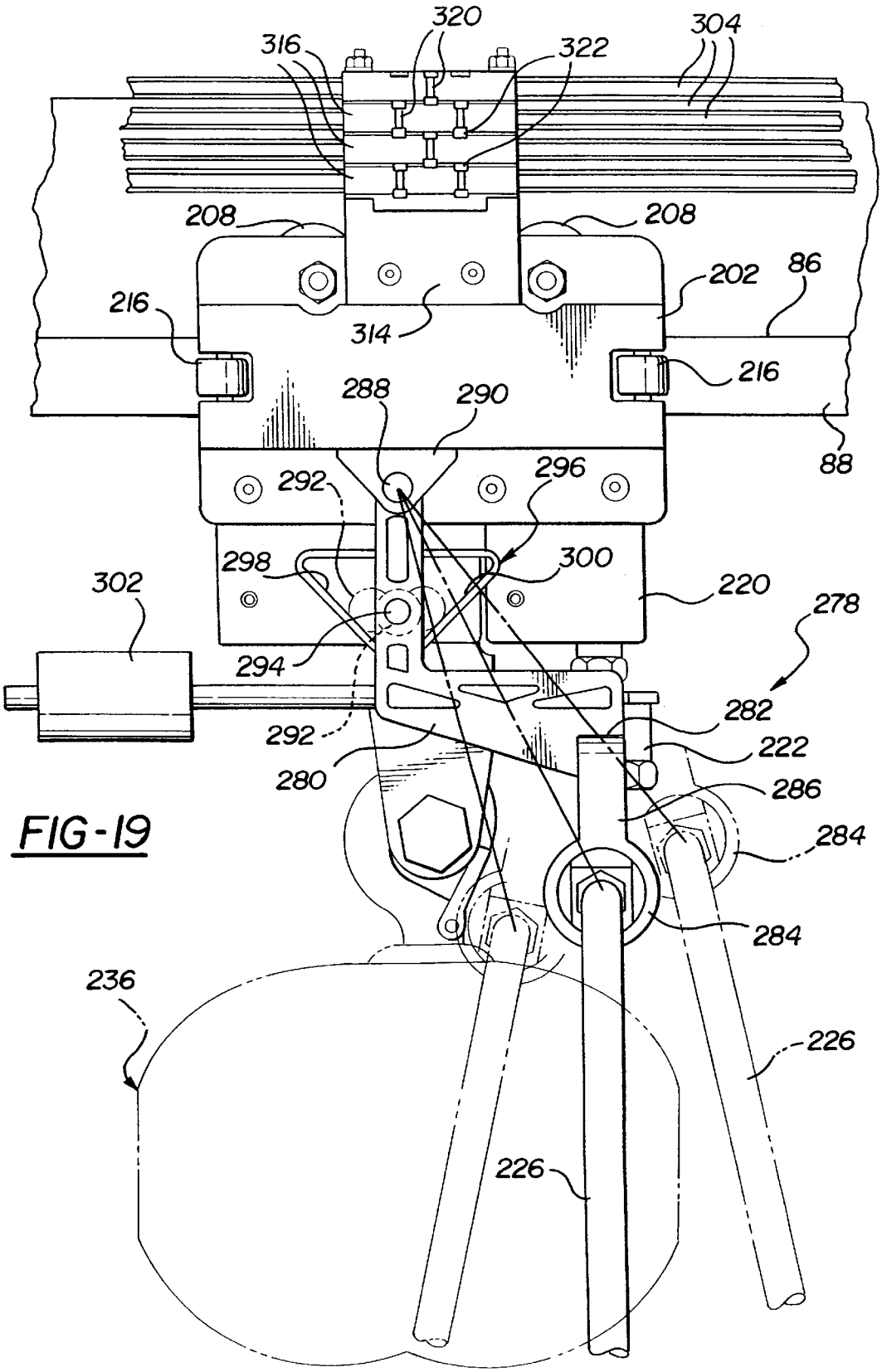
FIG. 19 is a side view of one embodiment of the pneumatic trolley having electrical delivery capabilities mounted to a rail.

In the embodiment illustrated in these figures, the release or disengagement of the trolley 200 from any given rail valve 102 and its movement along a rail is effected by the operator by pulling on the hose 226. However, those having ordinary skill in the art will appreciate that a cable or some other suitable device may be substituted for the hose without departing from the scope of the invention. The hose 226 engages the retaining ring 284 which translates this force from the lower arm 282 to the upper arm 280. As best shown in FIG. 19, the upper arm 280 has an L shape and is pivotable about a pin 288 mounted to clevis 290 bolted to one of the frame members 202. The upper arm 280 also carries a roller 292, shown in phantom, which is mounted on a shaft 294. A triangularly shaped release cam, generally indicated at 296 is formed on the lower end of the slide 268. The release cam 296 presents two angularly disposed cam surfaces 298, 300. The roller 292 carried by the upper arm 280 is received by the release cam 296 and is adapted to engage one or the other of the cam surfaces 298, 300 when the upper arm 280 is pivoted about the pin 288. When the roller 292 engages one of the cam surfaces 298, 300, the slide 268 is moved downwardly as viewed in these figures. Downward movement of the slide 268 causes the lever 262 to pivot about the pin 272 shown in FIG. 17 which, in turn, moves the magnet head 254 against the biasing force of the coiled spring 256. This movement causes the control valve 138 to close causing the pressure in the rail valve 102 to equalize. The valve member 118 is then seated against the valve seat 120 and pneumatic flow through the trolley 200 is interrupted. The trolley 200 is now free to move along the rail in either direction until it may be selectively coupled in pneumatic relation with another rail valve 102 as the operator so desires.

When the release mechanism 278 is not being employed, the roller 292 is positioned between the cam surfaces 298, 300. To this end, the release mechanism 278 may also include a counter balance, generally indicated at 302, which is cantilevered from the upper arm 280 at a location spaced from the lower arm 282 so as to counteract the weight of the lower arm 282 as it supports the hose 226 and any pneumatic tools (not shown).

Figure 20:
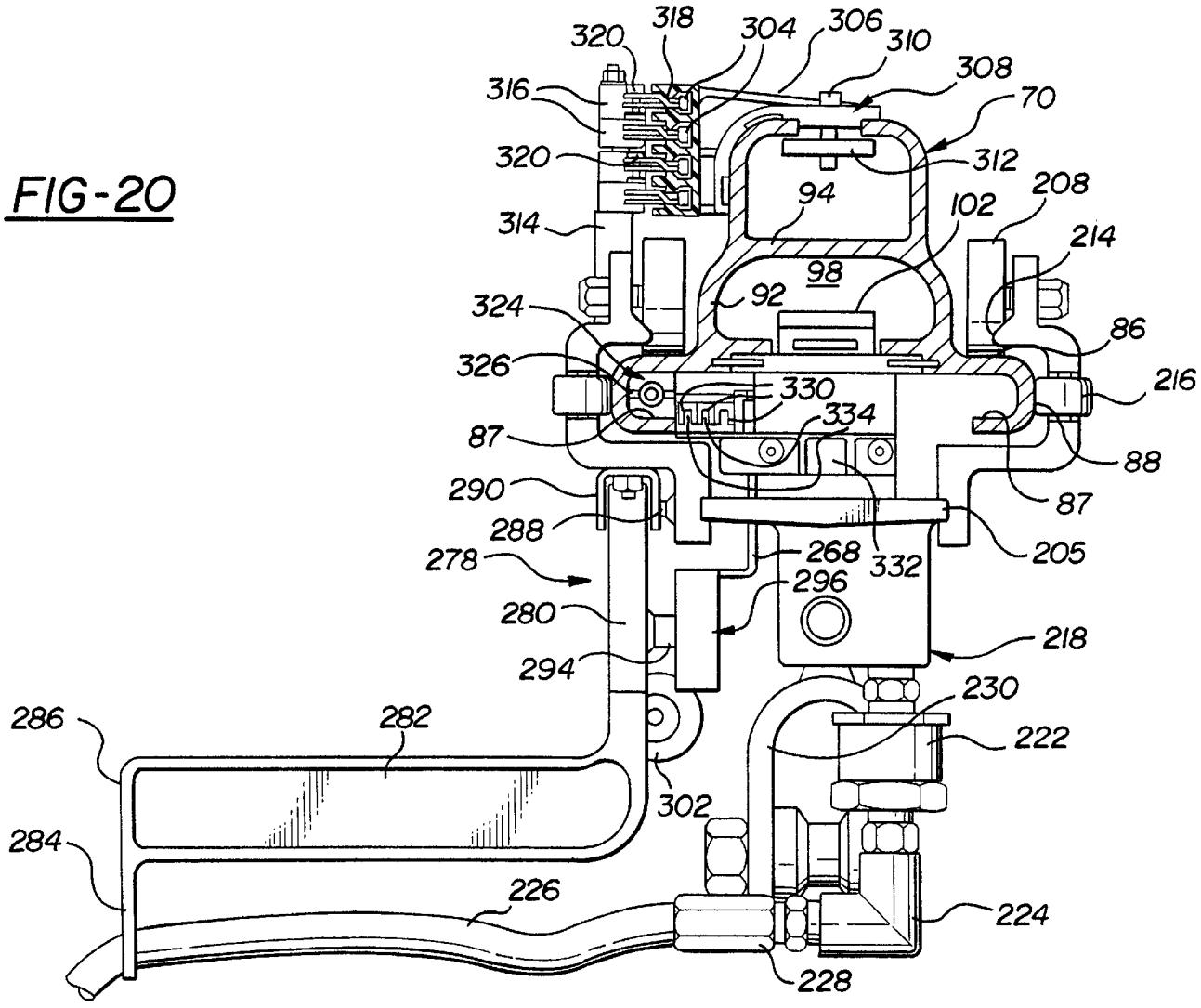
FIG. 20 is an end view of the pneumatic trolley having electrical delivery capabilities mounted to a rail.

As alluded to above, and as best shown in FIGS. 19 and 20, the trolley 200 may also have electrical power delivery capabilities for operating electrical tools throughout the work environment. In this event, electrical busses 304 are supported by the rail above the flange portion 72 by a plurality of buss clips 306 disposed at spaced intervals along the rail. Each buss clip 306 includes a fastening mechanism, generally indicated at 308, which engages the hanger portion 70 of the rail. The fastening mechanism 308 may include a threaded fastener 310 and a nut plate 312 which cooperates to clamp each buss clip 306 to the hanger portion 70 of the rail.

On the other hand, the trolley 200 includes an electrical mount 314 bolted to at least one of the frame members 202 between the trolley wheels 208. A plurality of conductors 316 corresponding to each buss 304 are carried by the electrical mount. Each conductor 316 has contacts 318 which are received in an associated buss 304. Each contact 318 is connected to a threaded screw 320. Each screw 320 includes an aperture schematically shown at 322 in FIG. 19, to which a wire may be crimped to translate voltage from the buss 304 to any electrically actuated equipment. In the embodiment disclosed herein, there are four busses 304 which supply 480 volt power.

In addition, or in the alternative, the rail may also have 110 volt power as generally indicated at 324 in FIG. 20. There, the rail supports a plurality of lugs 326 which are shaped so as to be received on the inner curved mounting surface 87 of the flange portion 72 opposite the runway, guide roller and kick up surfaces. In turn, the lug 326 supports three 110 volt busses 330. A conductor plate 332 is bolted to the outside of the trolley housing 204 and supports three contacts 334 which are complementarity received in an associated buss 330. 110 volt power may then be translated to any electrically powered device via the conductor plate 332 in any conventional manner even as the trolley 200 is moved along the rail. In a similar way, the busses 330 may be used to deliver 60 Amp, single phase power via the trolley 200 to an appropriately powered device. Also, busses 330 may be routed on both sides of the rail through the space defined between the runway surfaces and the kick up surfaces on the rail.

In this way, pneumatic power may be cleanly and efficiently delivered to associated tools using movable trolleys 200 which have the capability of coupling and decoupling with rail valve 102 supported at spaced intervals within the conduit 98 of the rail. The aluminum alloyed rail does not corrode like the black pipe of the prior art. Thus, leaks due to corrosion are eliminated thereby significantly reducing associated power losses. Cluttered work environments due to the spaghetti-like array of branch lines and connectors to branch lines like the related art are also eliminated. These results are achieved in a pneumatic rail and trolley system which provides the sufficient air flow and pressure necessary to power pneumatic tools. And, unlike anything in the related art, the rail and trolley system of the present invention also provides electrical power to any compatible tools. This feature greatly reduces the need for power cords and extension cords which typically litter aisleways and work areas in the related art.

Figure 21:
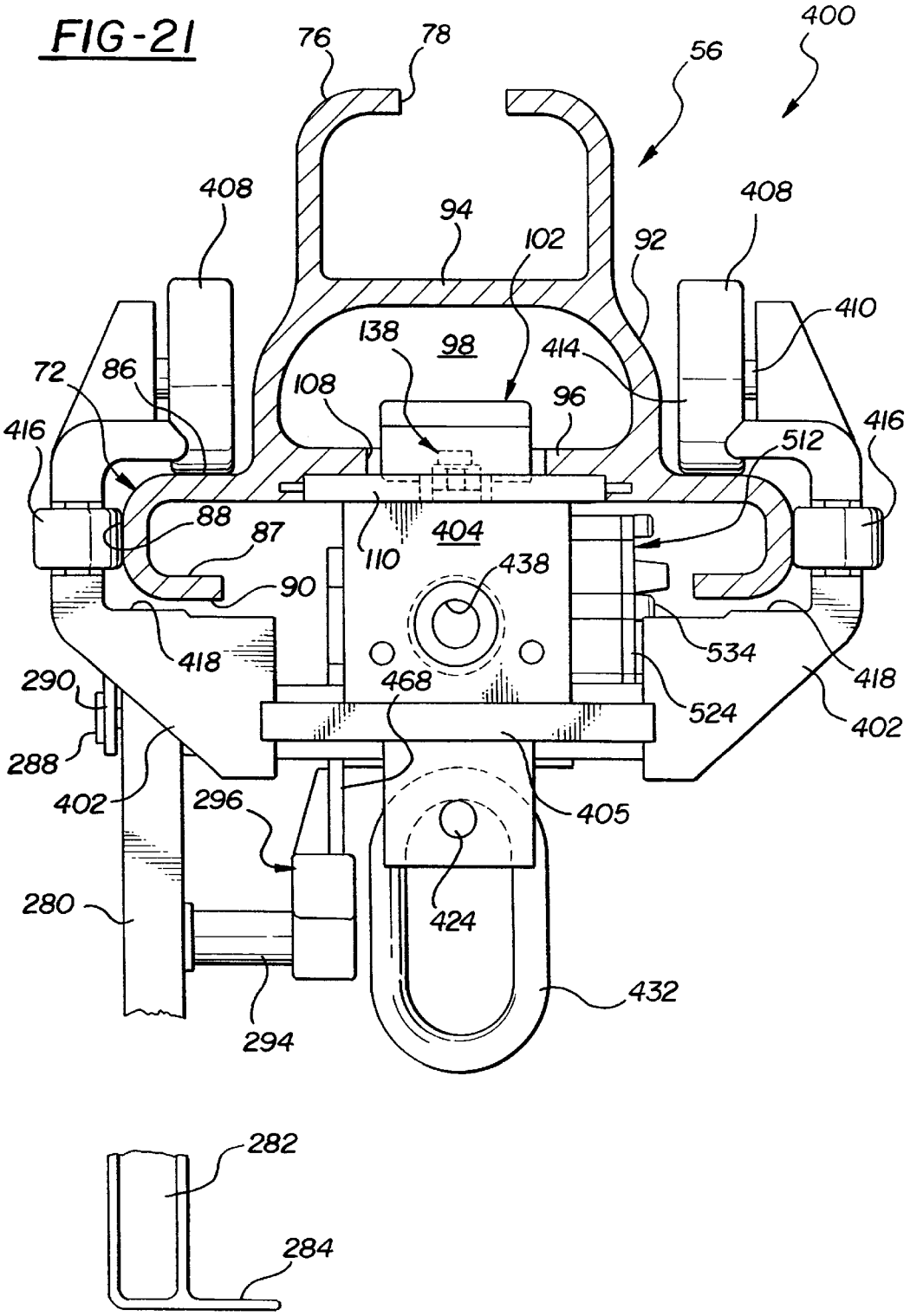
FIG. 21 is an end view of an alternate embodiment of the pneumatic trolley of the present invention mounted on a rail.
Figure 22:
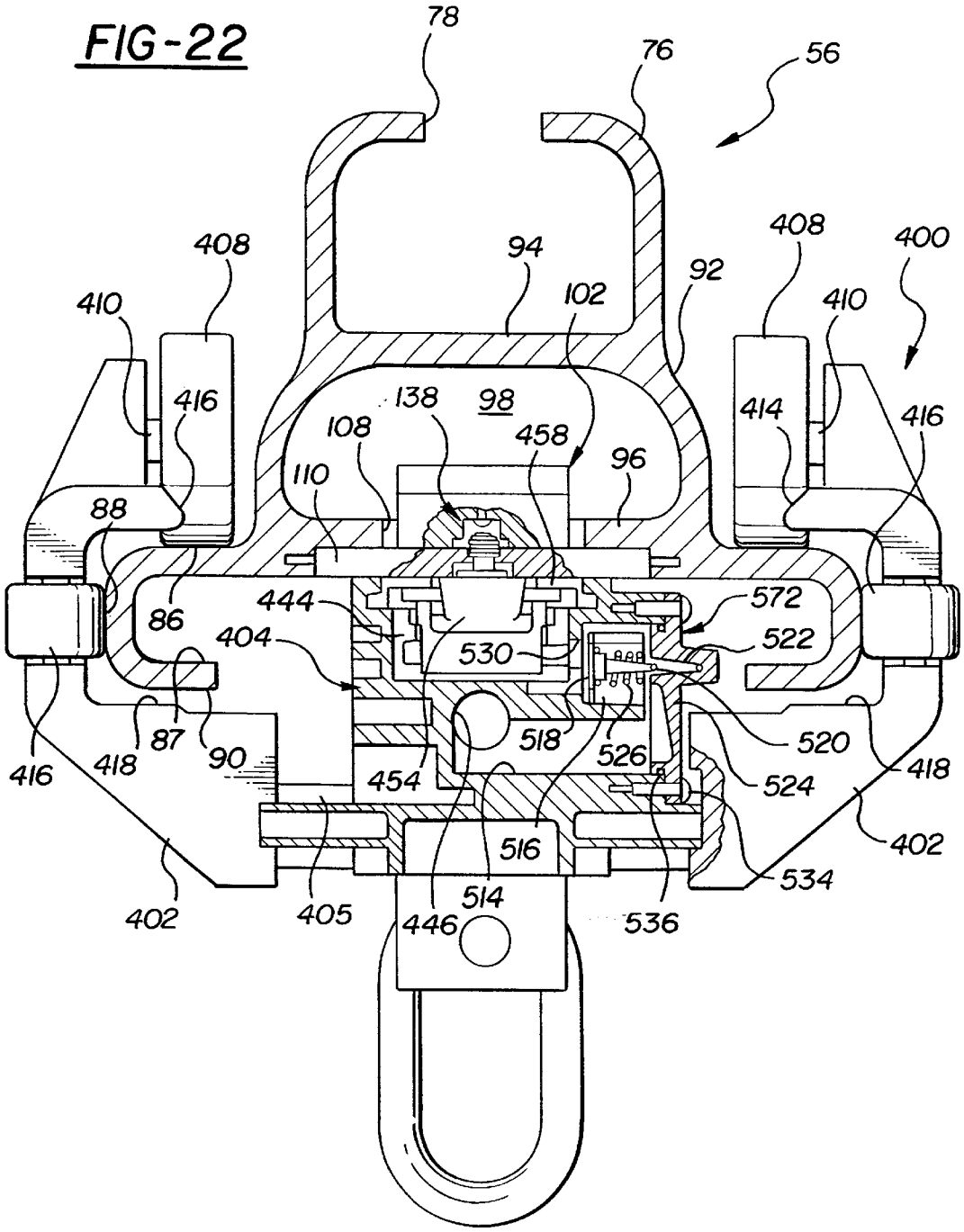
FIG. 22 is a partial cross-sectional side view of the alternate embodiment of the pneumatic trolley illustrated in FIG. 21.

Referring generally to FIGS. 21 through 26, and specifically to FIGS. 21 and 22, alternate embodiment of the pneumatic trolley is generally indicated at 400. Like the pneumatic trolley 200 shown in FIGS. 17 through 20, the pneumatic trolley 400 includes a pair of opposed, but identical frame members 402. The frame members 402 may be manufactured from extruded, anodized aluminum, 6005T5 ANSI standard, plastic, injectable polymer or any other suitable material. As with the frame members 112, if made from polymer, the inventors have found that UV stabilized Delrin 577, a 20% glass-filled reinforced acetal available from Dupont works well for the frame members 402. Each frame member 402 is supported for rolling contact with the rail. More specifically, each frame member 402 includes one or more trolley wheels 408 rotatably mounted thereto and adapted for rolling contact with a corresponding runway surface 86 of the rail flange portion 72. To this end, each trolley wheel 408 may be rotatable upon a shaft 410 supported by the frame member 402. Each frame member 402 also presents at least one safety lug 414 which projects over the plane of the associated runway surface 86 of the flange portion 72. In the unlikely event of a catastrophic failure of one or more trolley wheels 408, the safety lug 414 will catch the running surface 86 and prevent the trolley 400 from falling off the rail.

From the trolley wheel 408, each frame member 402 generally follows the contour of the flange portion 72 of the rail. Further, at least one or more guide rollers 416 is roll-pinned or otherwise mounted to each frame member 402 opposite the guide roller surface 88 of the flange portion 72. Each guide roller 416 is adapted for rolling engagement with the guide roller surface 88 and assists in stabilizing the trolley 400 relative to the rail. Additionally, the trolley may also include a kick up pad 418 which engages the kick-up surface 90 of the flange portion 72 and minimizes wear.

The trolley wheel 408 may be manufactured from Delrin 570, which is a 20% glass-filled reinforced injection acetal available from Dupont. Additionally, the guide rollers 416 may also be manufactured from Dehrin 570 or even Celcon M90 which is also an injection acetal but is available from Hoechst Celanese. Together, the trolley wheels 408, guide rollers 416, kick up pads 418 and, to the extend they are employed, the kick up rollers facilitate smooth, rectilinear motion of the pneumatic trolley 400 along the rail.

The trolley 400 also includes a housing 404 which is supported between the frame members 402. As best shown in FIGS. 21 through 22, the trolley housing 404 is plastic and includes a base plate 405 which extends between and is operatively supported by the frame members 402.

Figure 23:
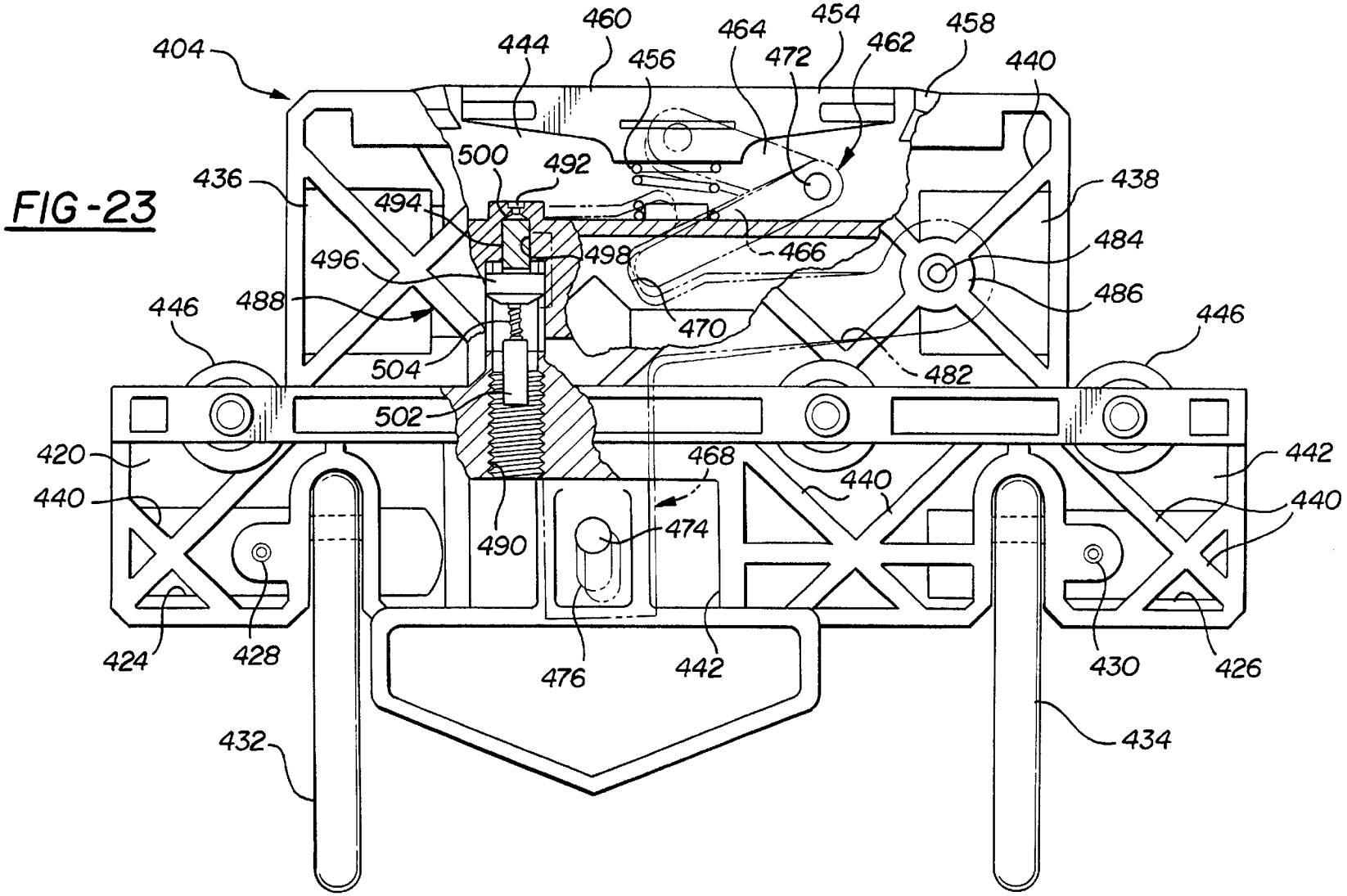
FIG. 23 is a cross-sectional side view of the trolley housing of the alternate embodiment of the pneumatic trolley illustrated in FIGS. 21 through 22.
Figure 24:
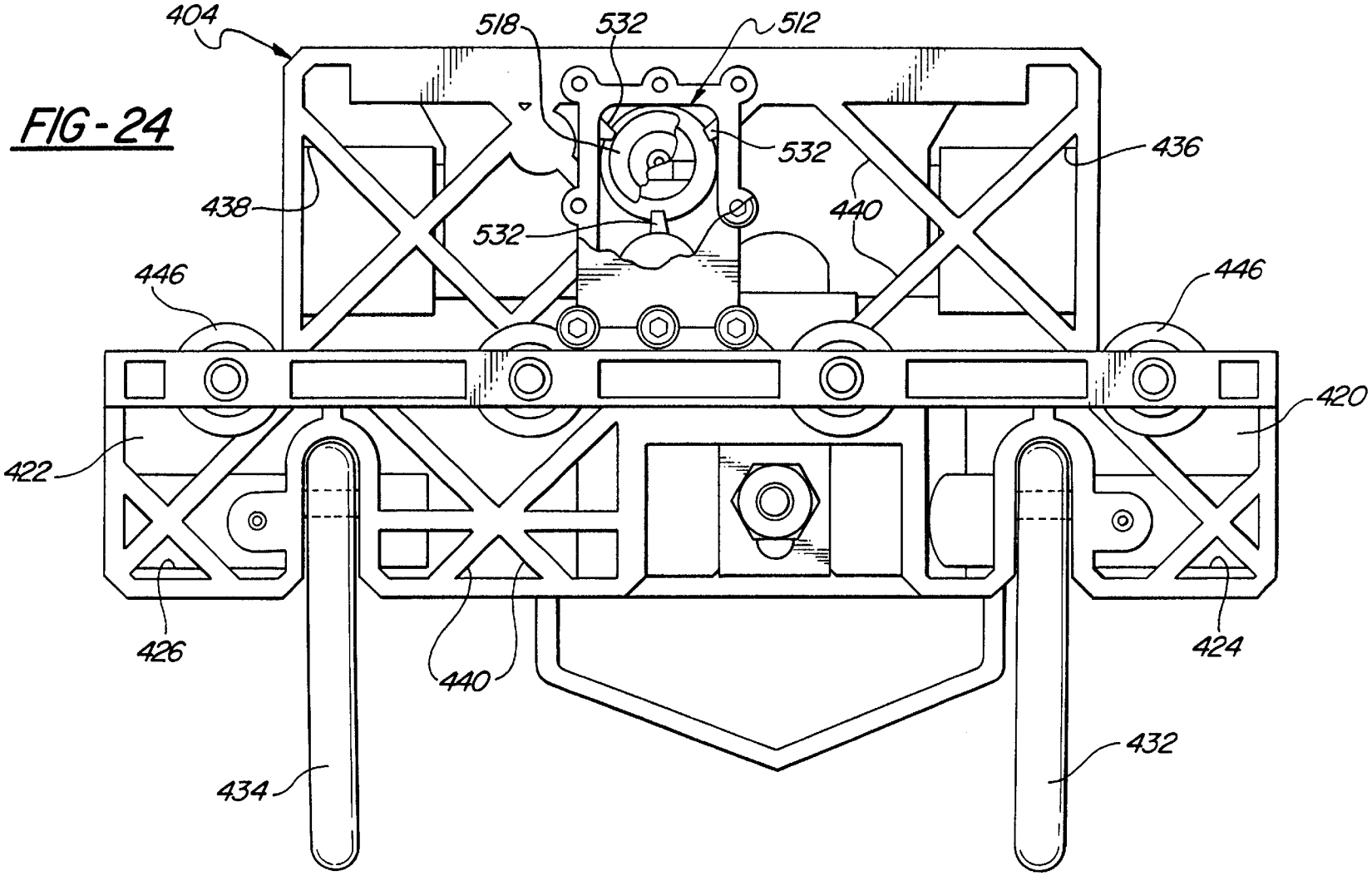
FIG. 24 is the opposite cross-sectional side view of the trolley housing illustrated in FIG. 23.

As best shown in FIGS. 23 through 24, the trolley housing 404 has a pair of opposed clevises 420, 422. Each clevis 420, 422 presents a bore 424, 426 in which is received a pin (not shown). Each pin is secured in its respective bore 424, 426 by a roll pin 428, 430 or any other suitable fastening mechanism. Each clevis 420, 422 and associated pin supports a ring 432, 434. In turn, the rings 432, 434 may be employed to support a balancer, related hoist equipment, tool or the like as described in connection with the trolley 200 illustrated in FIGS. 18 through 20. The housing 404 may also include molded ribs 440 strategically located throughout the housing 404 for added strength. Further, the housing 404 may present plastic bosses 446 which receive fasteners (not shown) for mounting the housing 404 to the frame members 402.

Referring now to FIGS. 22 through 23, the inner workings of the trolley housing 404 operates to selectively open and close the rail valve 102 to provide and interrupt, respectively, pneumatic pressure to a tool. To that end, within the trolley housing 404 there is an air chamber 444 which receives air from the conduit 98 through the rail valve 102. Fluid communication is provided from the air chamber 444 to the hose 226 and ultimately a pneumatically operated tool via an axial flow passage 446 extending through the trolley housing 404. The trolley housing 404 may actually provide fluid communication to a pneumatic tool through any one of three ports 436, 438 or 442. The ports 436, 438 are formed in the front and rear of the trolley housing 404 and port 442 is formed in the bottom of the housing 404. Each port 436, 438 and 442 is in direct fluid communication with the axial flow passage 446. When not in use, any one of the ports 436, 438 or 442 may be plugged.

The flow of air into the air chamber 444 is controlled by the movement of an actuator, such as a magnet head 454, which is movably supported within the air chamber 444 and is biased toward the top of the chamber 444 by a coiled spring 456 or any other suitable biasing member. The magnet head 454 is surrounded by a gasket 458 or other suitable sealing device which is operatively mounted in the housing 404. The magnet head 454 includes a magnet 460 supported therein. The magnet 460 is adapted to actuate the control valve 138 by attracting its ferromagnetic head 144 thereby unseating the plunger 148 from the opening in the control orifice 140 and opening the valve member 118 allowing pressurized air from the conduit 98 to flow into the air chamber 444 as described above in connection with FIG. 17.

The magnet head 454 may be moved away from the control valve 138 and against the biasing force of the coiled spring 456 by actuation of a lever, generally indicated at 462 in FIG. 23. This movement closes the control valve 138 which causes the valve member 118 to be seated on the valve seat 120 thereby interrupting the flow of air into the trolley 400.

Figure 26:
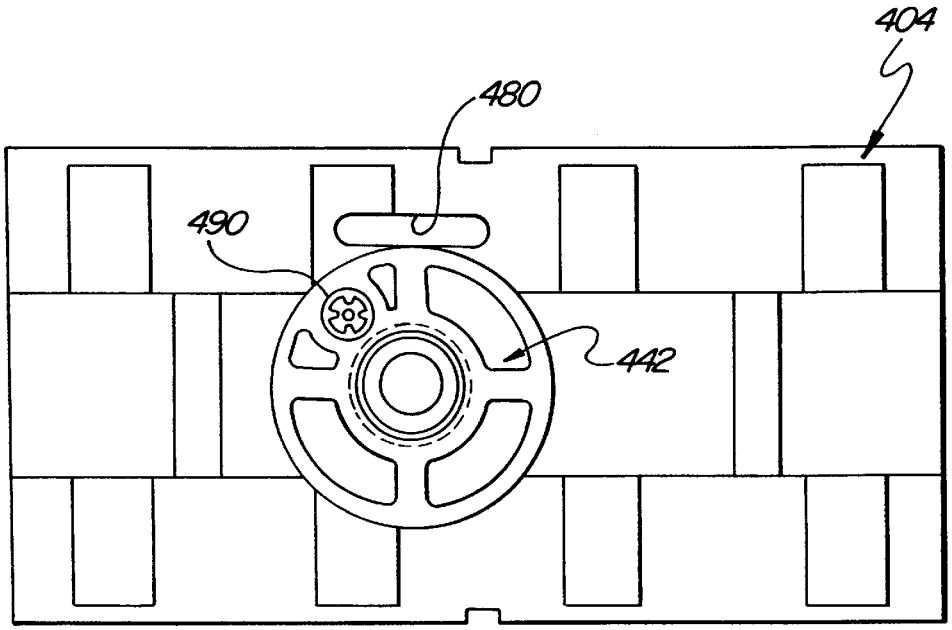
FIG. 26 is a bottom view of the trolley housing of the alternate embodiment of the pneumatic trolley illustrated in FIGS. 21 through 24.
Figure 27:
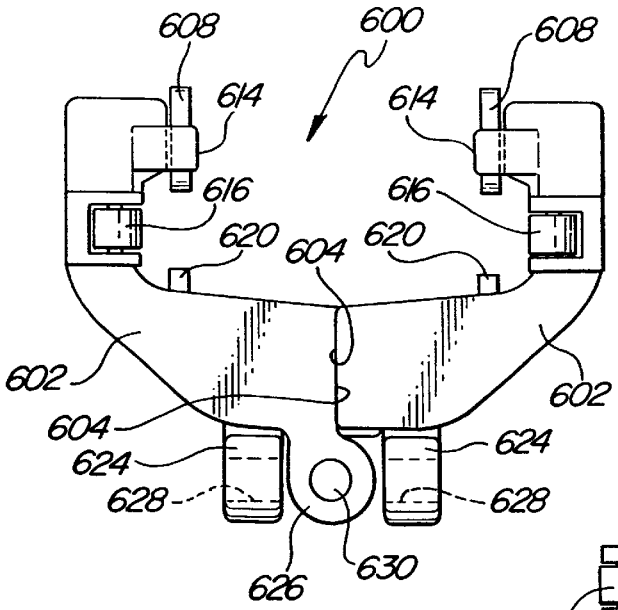
FIG. 27 is an end view of a load bearing trolley of the present invention.
Figure 28:
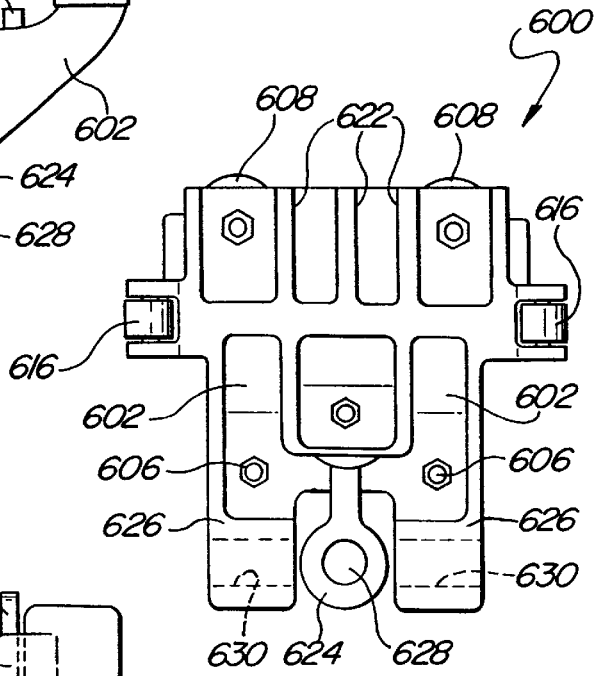
FIG. 28 is a side view of the load bearing trolley illustrated in FIG. 27.
Figure 29:
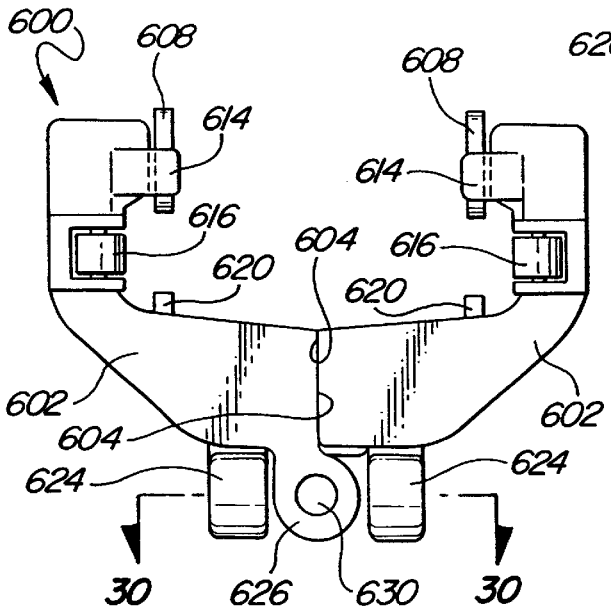
FIG. 29 is the opposite end view of the load bearing trolley illustrated in FIG. 27.

The lever 462 includes a first member 464 operatively coupled to the magnet head 454 and a second member 466 operatively coupled to a vertically extending slide, generally indicated at 468 via a notch 470. Both first and second members 464, 466 are rotatable together about a pin 472. While the lever 462 may be manufactured from discrete members 464, 466 and a pin 472, in the preferred embodiment disclosed herein, the lever 462 is an integral, one-piece plastic device which is rotatable about the axis of the pin 472 to impart linear movement on the magnet head 454. The slide 468 is movably mounted to the trolley housing 404 via fasteners 474 which are received in slots 476 on the slide 468. As best shown in FIGS. 23 and 26, the slide 468 extends through a slot 480 in the trolley housing 404 and includes a cantilever arm 482 which is pivotable about a pin 484 mounted in the boss 486 of the housing 404. The lever and slide 462, 468, respectively, form a part of a release mechanism generally indicated at 278 in FIGS. 18 through 20 as described above.

In addition to the magnet head 454, the slide 468 actuates a bleed valve, generally indicated at 488. The bleed valve 488 is mounted in a threaded bore 490 extending from a bottom of the housing 404 and associated with the port 442 as shown in FIG. 26. The bleed valve 488 controls the depressurization of the air chamber 444 through a bleed orifice 492 as will be described in greater detail below.

Figure 25:
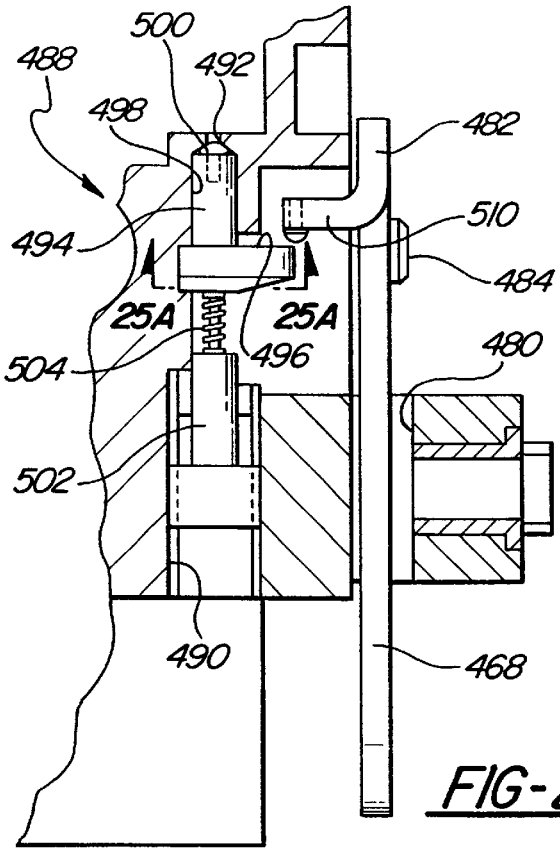
FIG. 25 is a partial cross-sectional side view illustrating the bleed valve of the present invention.
Figure 25A:
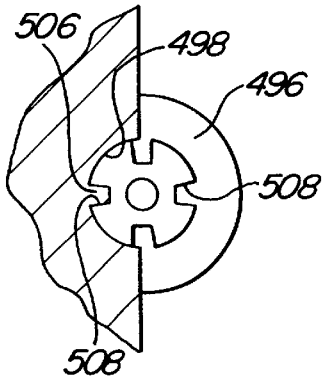
FIG. 25A is a section taken substantially through lines 25A—25A of FIG. 25.

Referring now to FIGS. 23 and 25, the bleed valve 488 includes a valve member 494 extending from a platform 496 and movably supported in a guide passage 498. The valve member 494 terminates in a frustoconical plug 500 which seals the bleed orifice 492. A spring set 502 is threadably mounted in the bore 490. A spring 504 acts between the platform 496 and the spring set 502 to bias the valve member 494 into sealing engagement with the bleed orifice 492. Rectilinear motion of the valve member 494 is assisted by guides 506 formed on the guide passage 498 which are complementarity received in slots 508 formed on the valve member 494 (FIG. 25A). As best shown in FIG. 25, the slide 468 presents a tang 510 located on the arm 482 generally opposite the pin 484. The tang 510 is adapted to engage the platform 496 thereby moving the valve member 494 out of sealing engagement with the bleed orifice 492. Thus, movement of the slide 468 to interrupt fluid communication to the air chamber 444 simultaneously moves the bleed valve 488 to open the bleed orifice 482 thereby depressurizing the air chamber 444 through the bleed orifice 492 and the guide passage 498 to atmosphere via port 442.

In addition, the housing 404 supports a check valve, generally indicated at 512 in FIGS. 22 and 24. The check valve 512 is positioned between the air chamber 444 and the axial flow passage 446. A delivery passage 514 extends between the check valve 512 and the axial flow passage 446. The check valve 512 prevents back flow up into the trolley housing 404 from the pneumatic tool or hose 226 during depressurization of the air chamber 444 and thereby prevents reverse pressure surges acting on the magnet head 454. The check valve 512 may also be used as a governor to limit the flow of pressurized air from the trolley housing 404 and thereby limit the rpm of the air tool. This feature is useful when smaller tools are used in conjunction with the material handling system of the present invention.

The check valve 512 is movably supported in a check valve chamber 516 between open and closed positions and includes an annular head 518 and a needle shaped stem 520 extending therefrom. The stem 520 may be received in a needle seat 522 formed in a check valve chamber end cap 524. A biasing member such as a coiled spring 526 biases a seal formed on the annular head 518 into sealing engagement with a port 530 interconnecting the air chamber 444 and the check valve chamber 516. As best shown in FIG. 24, the check valve chamber 516 presents three guide tabs 532 annularly spaced relative to one another. The guide tabs 532 engage the valve head 518 to ensure smooth rectilinear movement thereof.

The end cap 524 is removably mounted to the trolley housing 404 using fasteners 534. O-rings 536 serve to ensure the check valve chamber 516 remains sealed.

However, the end cap 524 is removable so that the check valve 512 may be serviced or so that the coil spring 526 may be changed. The larger the diameter of the coiled spring, the lower the flow past the check valve 512 and, accordingly, the lower the rpm generated at the pneumatic tool.

Together, the bleed valve 488 and the check valve 512 cooperate to ensure smooth operation of the pneumatic trolley 400 during decoupling from a rail valve 102. More specifically, during decoupling, the bleed valve 488 is opened so that the air chamber 444 is depressurized. This unbalances the check valve 512 causing it to close. Closing the check valve 512 prevents surges of pressurized air from downstream of the check valve 512 back into the depressurized air chamber 444. Thus, actuation of the slide 468 results in the following sequential actions: the magnet head 454 is moved against the biasing force of the coiled spring 456; the control valve 138 closes; the rail valve member 118 then closes; the bleed valve 488 opens which depressurizes the air chamber 444 and the check valve 512 closes. The above-identified structure facilitates smooth coupling and de-coupling of the trolley housing 404 with any given rail valve 102.

Load Bearing Trolley

The material handling system of the present invention also includes a load bearing trolley, generally indicated at 600 in FIGS. 2 and 27 through 30. While the load bearing trolley shares certain common features described with respect to the pneumatic trolleys 200, 400 above, the load bearing trolley 600 is specifically adapted to carry relatively heavy loads. To that end, the load bearing trolley 600 includes a pair of opposed, but identical, frame members 602 which are arranged relative to each other to form opposite hands. Each frame member 602 may be cast aluminum magnesium alloy (535) so as to present a flat mating surface 604 which is specifically adapted for abutting contact with a corresponding surface 604 on the opposite hand. The frame members 602 are fastened together using bolts 606 or any other suitable fastener received in threaded apertures (not shown) such that the bolts span the mating surfaces 604.

Each frame member 602 is supported for rolling contact with the rail. More specifically, each frame member 602 includes at least one or more trolley wheels 608 rotatably mounted thereto and adapted for rolling contact with a corresponding runway surface 86 of a flange portion 72 of a rail. Each frame member 602 also presents at least one safety lug 614 which projects over the plane of the associated runway surface 86 of the flange portion 72. In the unlikely event of a catastrophic failure of one or more trolley wheels 608, the safety lug 614 will catch the running surface 86 and prevent the trolley 600 from falling off the rail.

From the trolley wheel 608 each frame member 602 generally follows the contour of the flange portion 72 of the rail. Further, one or more guide rollers 616 is roll pinned, or otherwise mounted to each frame member 602 opposite the guide roller surface 88 of the flange portion 72. Each guide roller 616 is adapted for rolling engagement with the guide roller surface 88 and assists in stabilizing the trolley 600 relative to the rail. Additionally, the trolley may also include at least one kick up roller 620 which engages the kick up surface 90 of the flange portion 72. More specifically, the guide rollers 616 are rotatable about an axis which is perpendicular to the axis of rotation of the trolley wheel 608 supported on the associated frame member 602. The kick up rollers 620 are rotatable about axes which are parallel to the axis of rotation of the trolley wheel 608.

The trolley wheel 608 may be manufactured from Delrin 570, which is a 20% glass-filled, reinforced injection acetal available from Dupont. Additionally, the guide rollers 616 may also be manufactured from Dehrin 570 or even Celcon M90 which is an injection acetal but is available from Hoechst Celanese. Together, the trolley wheels 608, guide rollers 616 and kick up rollers 620 facilitate smooth, rectilinear motion of the load bearing trolley 600 along the rail.

Figure 30:
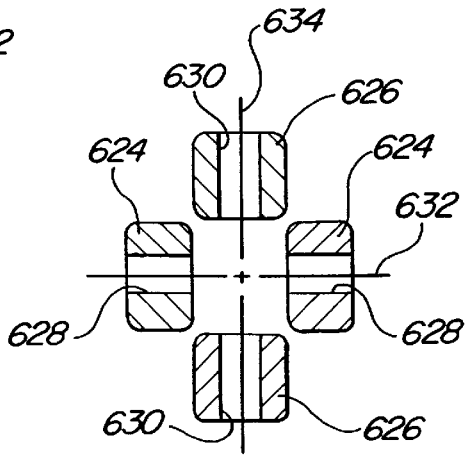
FIG. 30 is a bottom view illustrating the arrangement of the mounting lugs of the load bearing trolley of the present invention.

Each frame member 602 may also include ribs 622 formed integrally with the frame member 602 and strategically arranged for providing increased strength to the frame. Each frame member 602 further includes a pair of lugs 624, 626 formed on the underside of the frame member 602. The lugs 624, 626 present apertures 628, 630, respectively, extending therethrough. As best shown in FIG. 30, each aperture 628 has an axis indicated at 632. Each aperture 630, respectively has an axis indicated at 634. The lugs 624, 626 are arranged relative to one another on each frame member 602 such that the axes 632,634 extending through the apertures 628, 630 form a 90° angle relative to one another. When the two frame members 602 have been fastened together, their respective lugs 624, 626 form a pattern as shown in FIG. 30. A pin (not shown) or other fastening device may extend between opposed lugs 624 or opposed lugs 626. The load suspended therefrom may be allowed to swivel about the common axis of the lugs 624 or lugs 626 where only one pin or fastening device is used. On the other hand, a load may be completely fixed between the lugs 624, 626. In either event, the load bearing trolley 600 facilitates the movement of loads along a bridge and runway system 42 or even a pneumatic rail 44. In addition, the electrical power may be supplied via the load bearing trolley 600 using essentially the same structure described for the pneumatic trolley 200 and shown in FIGS. 19 and 20.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A load bearing material handling system comprising:

a rail including a hanger portion adapted to interconnect said rail to a support structure, a body portion defining an enclosed conduit that extends for at least a portion of the length of said rail such that pressurized air may be delivered through said conduit to pneumatically actuated tools, and a flange portion adapted to movably support a trolley thereupon;

said flange portion including at least one runway surface extending for at least a portion of the length of said rail and laterally outward with respect to said body, and at least one kick up surface extending for at least a portion of the length of said rail and disposed in spaced relationship with respect to said runway surface so as to define a mounting surface disposed therebetween and which is adapted to support an electrical bus along at least a portion of the length of said rail.

2. A load bearing material handling system as set forth in claim 1 wherein said rail includes a plurality of lugs supported on said mounting surface of said flange portion between said runway and kick up surfaces, said lugs adapted to support electrical buses along at least a portion of the length of said rail.

3. A load bearing material handling system as set forth in claim 1 wherein said flange portion includes at least one guide roller surface disposed between said runway surface and said kick up surface and extending for at least a portion of the length of said rail.

4. A load bearing material handling system as set forth in claim 1 wherein said rail includes a pair of runway surfaces extending laterally from opposite sides of said body and parallel to one another for at least a portion of the length of said rail.

5. A load bearing material handling system as set forth in claim 4 wherein said rail includes a pair of kick up surfaces extending parallel to one another for at least a portion of the length of said rail and spaced from an associated pair of said runway surfaces so as to define a pair of mounting surfaces extending parallel with respect to one another and between said pair of runway and kick up surfaces.

6. A load bearing material handling system as set forth in claim 5 wherein said rail includes a pair of guide roller surfaces with each one of said pair of guide roller surfaces disposed between and extending parallel to an associated one of said pair of runway and kick up surfaces for at least a portion of the length of said rail.

7. A load bearing material handling system as set forth in claim 6 wherein each one of said pair of runway surfaces merging into one of said pair of guide roller surfaces, each one of said pair of guide roller surfaces merging into one of said pair of kick up surfaces.

8. A load bearing material handling system as set forth in claim 1 wherein said body is disposed between said hanger portion and said flange portion.

9. A load bearing material handling system as set forth in claim 1 wherein said body includes a pair of spaced side walls, an upper wall and a lower wall which together define said conduit.

10. A load bearing material handling system as set forth in claim 9 wherein said lower wall includes a plurality of openings disposed in spaced relationship with respect to one another along the length of said rail, a plurality of valves supported in said conduit through said openings, a source of pressurized air being in fluid communication with said conduit, said conduit providing fluid communication between said source of pressurized air and said plurality of valves.

11. A load bearing material handling system as set forth in claim 9 wherein said body includes an internal partition wall extending between said side walls and disposed between said upper and lower walls for providing added strength to said rail.

12. A load bearing material handling system as set forth in claim 1 wherein said hanger portion is defined by a pair of spaced claws extending upwardly relatively to said body, each of said claws including terminal ends which extend arcuately inward with respect to one another to present a gap therebetween, said hanger portion adapted to engage a plurality of yokes for supporting said rail above a work surface.

13. A load bearing material handling system as set forth in claim 1 wherein said system includes a plurality of rail segments coupled together to define said rail.

14. A load bearing material handling system as set forth in claim 13 wherein said rail segments include straight sections and curved sections.

15. A load bearing material handling system as set forth in claim 14 wherein each of said curved sections include half pieces defining inner and arcuate rail portions, said inner and outer rail portions coupled together to define each of said curved sections of said rail segments.

16. A load bearing material handling system as set forth in claim 13 wherein said system includes spliced connections disposed between sequential ones of said plurality of rail segments.

17. A load bearing material handling system as set forth in claim 1 wherein said rail includes air couplings adapted to interconnect said conduit with a source of pneumatic pressure.

18. A load bearing material handling system as set forth in claim 1 wherein said rail includes at least one terminal end and an end stop disposed at said terminal end of said rail, said end stop acting to seal said conduit.

19. A load bearing material handling system comprising:

a rail including a hanger portion adapted to interconnect said rail to a support structure, a body portion defining a conduit extending for at least a portion of the length of said rail and through which pressurized air may be delivered to pneumatically actuated tools, and a flange portion adapted to moveably support a trolley thereupon;

said conduit including a plurality of openings disposed in spaced relationship with respect to one another along the length of said rail, a plurality of valves supported in said conduit through said openings, a source of pressurized air being in fluid communication with said conduit and such that said conduit provides fluid communication between said source of pressurized air and said plurality of valves; and said flange portion including at least one runway surface extending for at least a portion of the length of said rail and laterally outward with respect to said body, and at least one kick up surface extending for at least a portion of the length of said rail and disposed in spaced relationship with respect to said runway surface so as to define a mounting surface disposed therebetween and which is adapted to support an electrical bus along at least a portion of the length of said rail.

* * * * *